United States Patent [19]

Haino et al.

[11] Patent Number: 4,702,983

[45] Date of Patent: Oct. 27, 1987

[54] ELECTROPHOTOGRAPHIC PHOTORECEPTOR COMPRISING BIS-AZO PIGMENT

[75] Inventors: Kozo Haino; Kazuhiro Emoto; Akira Itoh, all of Nagaokakyo, Japan

[73] Assignee: Mitsubishi Paper Mills, Ltd., Tokyo, Japan

[21] Appl. No.: 4,494

[22] Filed: Jan. 20, 1987

[30] Foreign Application Priority Data

Jan. 22, 1986 [JP] Japan ..... 61-12625
Jan. 22, 1986 [JP] Japan ..... 61-12626
Dec. 2, 1986 [JP] Japan ..... 61-287287

[51] Int. Cl.[4] ..... G03G 5/06; G03G 5/14
[52] U.S. Cl. ..... 430/75; 430/76; 430/58
[58] Field of Search ..... 430/75, 76, 58

[56] References Cited

U.S. PATENT DOCUMENTS 4,582,771 4/1986 Ohta ..... 430/76 X

*Primary Examiner*—J. David Welsh
*Attorney, Agent, or Firm*—Cushman, Darby & Cushman

[57] ABSTRACT

An electrophotographic photoreceptor excellent in properties after repeated use and durability is provided by containing a bis-azo pigment represented by the following general formula [I] or [II] in the light-sensitive layer on the conductive support:

[I]

wherein X represents —O—, —S—or >N—$R_4$ wherein $R_4$ represents a hydrogen atom, an alkyl group or an aralkyl group, $R_1$, $R_2$ and $R_3$ each represent a hydrogen atom, an alkyl group, an alkoxy group, an aryl group or a group of atoms necessary to form a condensed ring by combination of two or them, $Y_1$ and $Y_2$ each represent a hydrogen atom, a halogen atom, an alkyl group or an alkoxy group, A represents a coupler residue necessary to produce an azo pigment and n is 0 or 1;

[II]

wherein $Y_1$ and $Y_2$ each represent a hydrogen atom, a halogen atom, an alkyl group or an alkoxy group, $R_1$ and $R_2$ each represent a hydrogen atom, an alkyl group, an alkoxy group or a group of atoms necessary to form a condensed ring by combination of them, A represents a coupler residue necessary to produce an azo pigment and n is 0 or 1.

6 Claims, 1 Drawing Figure

ELECTROPHOTOGRAPHIC PHOTORECEPTOR COMPRISING BIS-AZO PIGMENT

BACKGROUND OF THE INVENTION

This invention relates to an electrophotographic photoreceptor and more particularly, to an electrophotographic photoreceptor which comprises a conductive support and a light-sensitive layer, provided thereon, containing a bis-azo pigment.

There have, heretofore, been known and widely studied and practically used inorganic photoconductive materials such as selenium, cadmium sulfide, zinc oxide, silicon, etc. for electrophotographic photoreceptors. In recent years, in addition to the inorganic photoconductive materials, organic photoconductive materials have also been actively studied and some of them have been practically used in electrophotographic photoreceptors.

In general, inorganic materials are not necessarily satisfactory, for example, selenium photoconductive material has problems in heat stability, deterioration of characteristics due to crystallization and difficulties in production and in the case of cadmium sulfide there are problems in moisture resistance, endurance and disposal of industrial waste. On the other hand, organic materials have advantages such as good film forming property, superior flexibility, lightness in weight, good transparency and easiness in design of photoreceptors for wide wavelength range by employing suitable sensitizing method. Thus, much attention has been attracted on practical use thereof.

The electrophotographic photoreceptors are, generally, required to have the following basic properties: (1) They can be charged highly with corona discharge in the dark. (2) Leakage of charges in the dark (dard decay) is a little. (3) Dissipation of charges upon exposure to light (light decay) takes place rapidly. (4) Residual charge after exposure to light is a little.

Photoconductive polymers such as polyvinylcarbazoles, etc. have been extensively studied as organic photoconductive materials. However, these are not necessarily satisfactory in film formability, flexibility and adhesion and besides they do not sufficiently possess the above enumerated basic properties required as photoreceptors.

On the other hand, organic low-molecular photoconductive compounds can provide photoreceptors excellent in mechanical properties such as film forming ability, flexibility, adhesion, etc. by proper selection of binders used for preparation of photoreceptors, but it is difficult to find compounds capable of retaining high sensitivity.

In an attempt to improve these problems, there has been developed an organic photoreceptor of high sensitivity in which the carrier generating function and the carrier transport function are respectively borne by different substances, such a type of photoreceptors called functionally separated type have the advantages in that the materials suitable for the respective functions can be selected from a wide range and photoreceptors having optional properties can be easily produced.

There have been proposed various photoreceptors of the functionally separated type which contain organic dyes or organic pigments as a carrier generating substance. For example, photoreceptors which contain dis-azo pigments or tris-azo pigments are disclosed in Japanese Patent Unexamined Publication (Kokai) Nos. 22834/79, 46237/81, 196241/82, etc. Sensitivity of these photoreceptors is not necessarily sufficient for practical use and further, they do not satisfy various requirements for electrophotographic process. Thus, further increase of sensitivity is desired.

In further recent years, as the light sources to be used for photoreceptors, there have been proposed laser beams of relatively shorter wavelength beams such as argon laser beams, He-Ne laser beam, etc. and further those of longer wavelength such as semiconductor laser beam. Thus, it has been earnestly desired to develop photoreceptors of high sensitivity which can use the wavelength of semiconductor laser beam (about 780 nm).

SUMMARY OF THE INVENTION

As a result of the inventors' intensive research of carrier generators excellent in carrier generating function which can use longer wavelengths of semiconductor laser, etc., it has been found that a specific bis-azo pigment is suitable for this purpose and photoreceptors excellent in durability and other properties after repeated uses can be provided.

DESCRIPTION OF THE INVENTION

Figure 1:
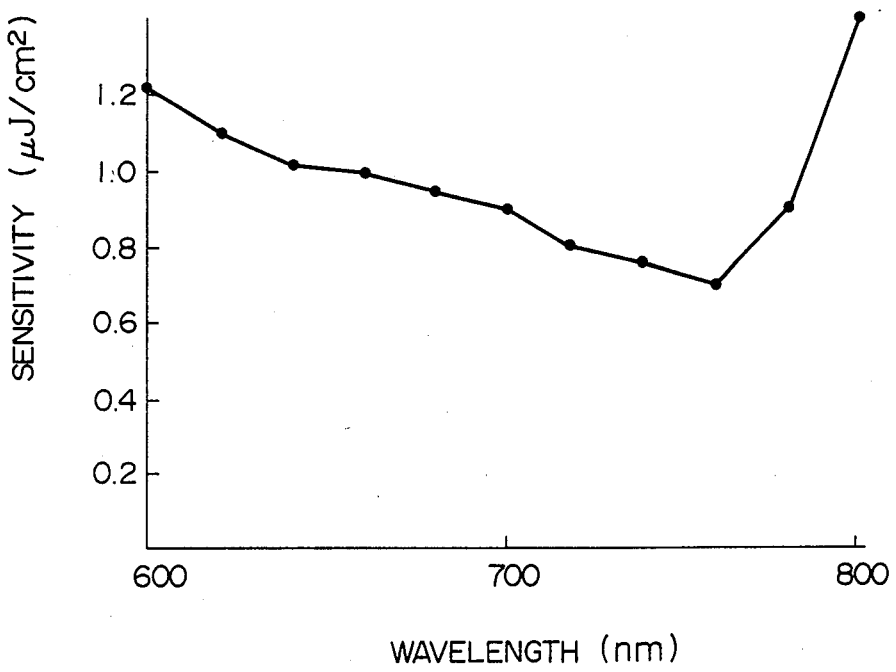
FIG. 1 is a spectral sensitivity curve of the photoreceptor produced in Example 12 given hereinafter.

This invention relates to an electrophotographic photoreceptor which comprises a conductive support and a light-sensitive layer, provided thereon, which contains a bis-azo pigment represented by the following general formula [I] or [II]:

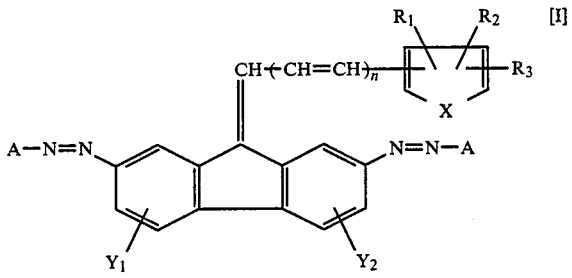

wherein X represents —O—, —S— or >N—$R_4$ where $R_4$ represents a hydrogen atom, an alkyl group or an aralkyl group, $R_1$, $R_2$ and $R_3$ each represents a hydrogen atom, an alkyl group, an alkoxy group, an aryl group or two of $R_1$, $R_2$ and $R_3$ being a group of atoms necessary to form a condensed ring by combination of them, $Y_1$ and $Y_2$ each represent a hydrogen atom, a halogen atom, an alkyl group or an alkoxy group, A represents a coupler residue necessary to produce an azo pigment and n is 0 or 1;

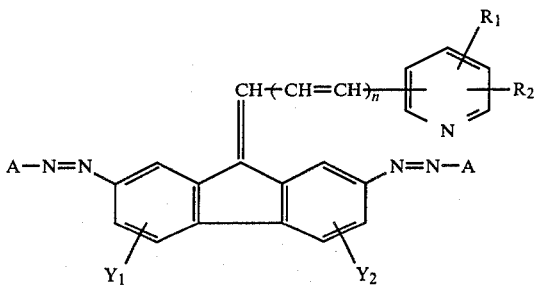

[II]

wherein $Y_1$ and $Y_2$ each represent a hydrogen atom, a halogen atom, an alkyl group or an alkoxy group, $R_1$ and $R_2$ each represent a hydrogen atom, an alkyl group, an alkoxy group or a group of atoms necessary to form a condensed ring by combination of $R_1$ and $R_2$, A represents a coupler residue necessary to produce an azo pigment and n is 0 or 1.

In the general formula [I], as examples of the heterocyclic ring containing X and substituted with the substituents $R_1$–$R_3$, mentioned may be made of pyrrole, thiophene and furan ring derivatives and as examples of $R_1$, $R_2$ and $R_3$, mention may be made of hydrogen atom, alkyl groups such as methyl, ethyl, propyl, isopropyl, etc., alkoxy groups such as methoxy, ethoxy, propoxy, etc. and aryl groups such as phenyl, tolyl, methoxyphenyl, chlorophenyl, etc. Furthermore, as examples of heterocyclic rings which condense with the ring containing X by bonding of two of $R_1$–$R_3$, there are indole ring, benzothiophene ring, and benzofuran ring derivatives. Examples of $Y_1$ and $Y_2$ are hydrogen atom, halogen atoms such as chlorine, bromine, etc., alkyl groups such as methyl, ethyl, propyl, etc. and alkoxy groups such as methoxy, ethoxy, propoxy, etc. Examples of $R_4$ are hydrogen atom, alkyl groups such as methyl, ethyl, propyl, etc. and aralkyl groups such as benzyl, phenethyl, etc.

As examples of A, mentioned may be made of aromatic rings and heterocyclic rings having the following skeletons which are capable of forming a pigment by coupling with a diazonium salt (in which "→" indicates the coupling position, Z represents a condensed ring and R represents a substituent.).

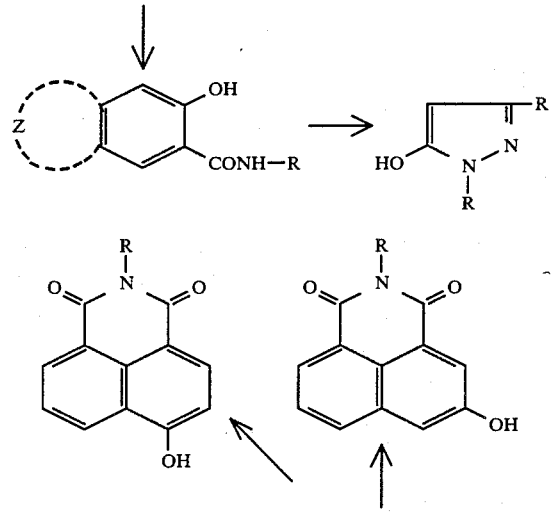

The azo pigment represented by the general formula [I] can be synthesized, for example, by the following process.

First, the outline of route of synthesis is shown below.

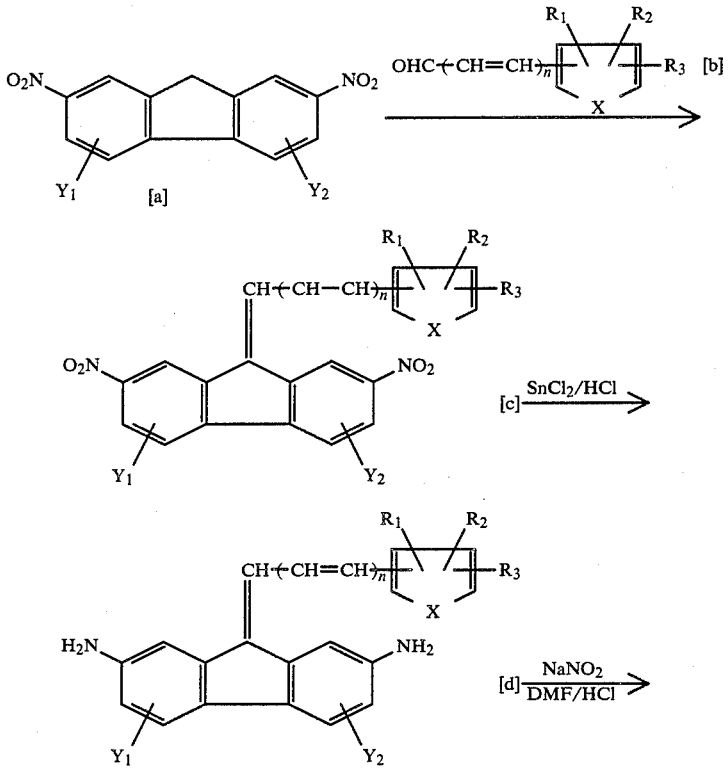

-continued

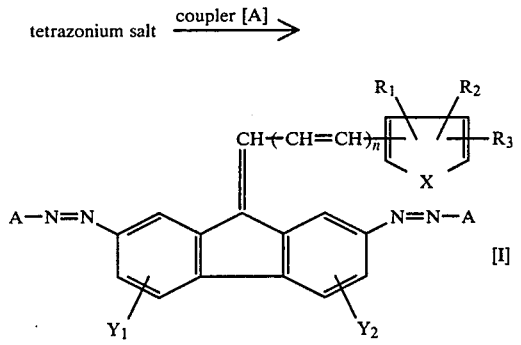

[I]

The synthesis of typical examples of bis-azo pigments through the above route is described below.

SYNTHESIS EXAMPLE 1

[Pigment No. 3)]

5.1 g of 2,7-dinitrofluorene, 2.1 g of furfural and 0.5 g of piperidine were mixed with 20 ml of ethyl alcohol and reaction was carried out in a sealed tube at a bath temperature of 150°-160° C. for 2 hours. The reaction product was washed with ethyl alcohol and then with pyridine with heating to obtain 5.7 g of an orange colored powder. m.p. 330° C. (dec.). Then, 5.7 g of thus obtained compound (intermediate [C] $R_1=R_2=R_3=H$, $X=O$, $Y_1=Y_2=H$, $n=0$) was dispersed in 60 ml of acetic acid and thereto was added a solution prepared by dissolving 25.3 g of $SnCl_2.2H_2O$ in 50 ml of concentrated hydrochloric acid, followed by carrying out reaction for 2 hours by stirring with heating at a bath temperature of 110°-120° C. to effect reduction of said compound. After filtration, the precipitate filtered off was rendered alkaline with a 25% aqueous NaOH solution, followed by extraction with ethyl acetate, washing with water and distillation of the solvent to obtain 2.3 g of diamino compound of reddish brown powder having a melting point of 180°-182° C. (intermediate [d]). 0.274 g of this diamino compound was dissolved in 5 ml of DMF. To the solution was added 0.4 ml of concentrated hydrochloric acid and then thereto was added dropwise a solution prepared by dissolving 0.145 g of $NaNO_2$ in 0.5 ml of water, at lower than 0° C. to carry out reaction for one hour to accomplish tetrazotization. The resulting tetrazonium salt was added dropwise to a solution of 0.76 g of a compound having the following formula as coupler [A]:

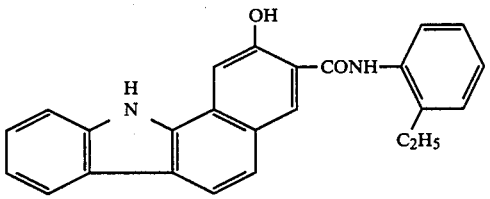

and 0.86 g of triethanolamine in 30 ml of DMF at lower than 0° C. to carry out reaction for 5 hours. Then, the reaction produced was filtered off and washed with water and then with acetone and DMF to yield 0.83 g of the objective pigment. m.p. 337° C. (decomp.)

λmax 625 nm in $H_2NCH_2CH_2NH_2$.

SYNTHESIS EXAMPLE 2

[Pigment No. (19)]

In the same manner as in Synthesis Example 1 except that 3.0 g of

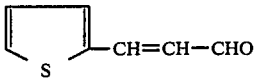

was used as the starting material [b], reacted was carried out to obtain 3.2 g of diamino compound ([d] $R_1=R_2=R_3=H$, $X=S$, $Y_1=Y_2=H$, $n=1$). m.p. 207°-210° C.

In the same manner as in Synthesis Example 1, a tetrazonium salt was prepared using 0.316 g of said diamino compound and the 0.70 g of the objective pigment was produced using 0.77 g of coupler [A] having the following formula:

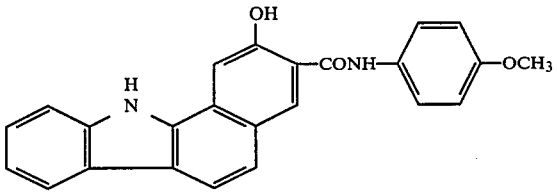

The pigment had a melting point of 327° C. (decomp.)

λmax 613 nm in $H_2NCH_2CH_2NH_2$

SYNTHESIS EXAMPLE 3

[Pigment No. (31)]

2.0 g of the diamino compound having the following formula was produced in the same manner as in Synthesis Example 1 except that 3.8 g of

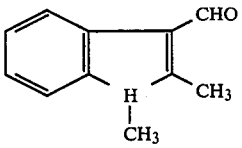

was used as starting material [b].

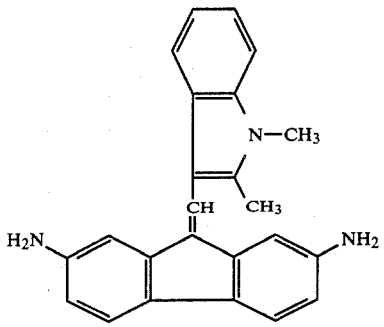

The diamino compound had a melting point of 235°–238° C.

In the same manner as in Synthesis Example 1, tetrazotization was carried out using 0.351 g of the above diamino compound and thereafter, reaction was effected using the same coupler [A] as in Synthesis Example 1 to yield 0.99 g of the objective pigment. m.p. 320° C. (decomp.)

λmax 630 nm in $H_2NCH_2CH_2NH_2$.

In the general formula [II], $Y_1$ and $Y_2$ are hydrogen atom, halogen atom such as chlorine, bromine, etc., alkyl group such as methyl, ethyl, propyl, etc. and alkoxy group such as methoxy, ethoxy, propoxy, etc., $R_1$ and $R_2$ are hydrogen atom, alkyl group such as methyl, ethyl, propyl, isopropyl, etc. and alkoxy group such as methoxy, ethoxy, propoxy, etc. and $R_1$ and $R_2$ may bond to each other to form a heterocyclic ring derivative which condenses with a pyridine ring, A is an aromatic ring or heterocyclic ring derivative capable of coupling with a diazonium salt to produce a pigment, which has for example, such skeleton as referred to for A in the general formula [I].

Especially preferred azo pigment in this invention is a compound represented by the following general formula (II-a).

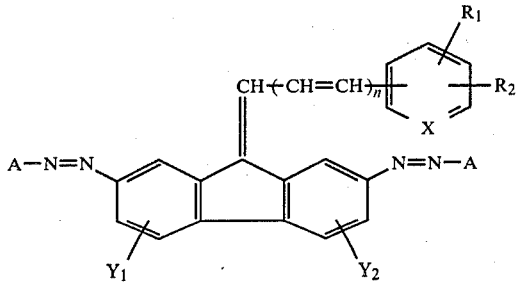

(wherein $Y_1$, $Y_2$, $R_1$, $R_2$ and n are the same as defined in the general formula [II], and A is

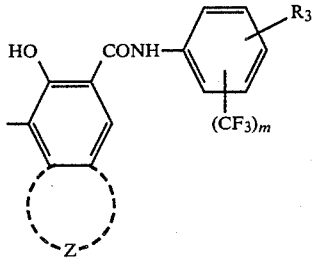

wherein m is 1 or 2, $R_3$ is hydrogen atom, a halogen atom, an alkyl group, cyano group or an alkoxy group and Z is a condensed ring).

The azo pigments having the coupler represented by A in the general formula (II-a) are disclosed in Japanese Patent Unexamined Publication (Kokai) No. 69072/86, No. 84653/86 and No. 84654/86. These azo pigments are relatively superior, but are still unsatisfactory in sensitivity and characteristics after repeated use.

It has been found that the azo pigments of the general formula (II-a) comprising markedly suitable combination of base (diamino compound) and coupler have superior sensitivity and characteristics after repeated use to those obtained by combination of other bases and other couplers. Especially, the azo pigments of the general formula (II-a) wherein the pyridine ring or heterocyclic ring derivative which condenses with the pyridine ring bonds at meta- or para-position exhibit the best result.

The azo pigment of the general formula [II] can be produced, for example, by the following processes.

First, the outline of the route of synthesis is shown below.

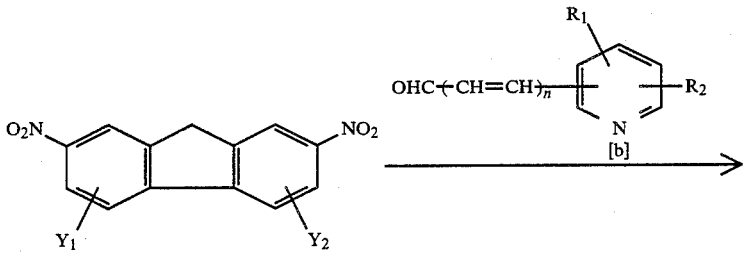

[a]

-continued

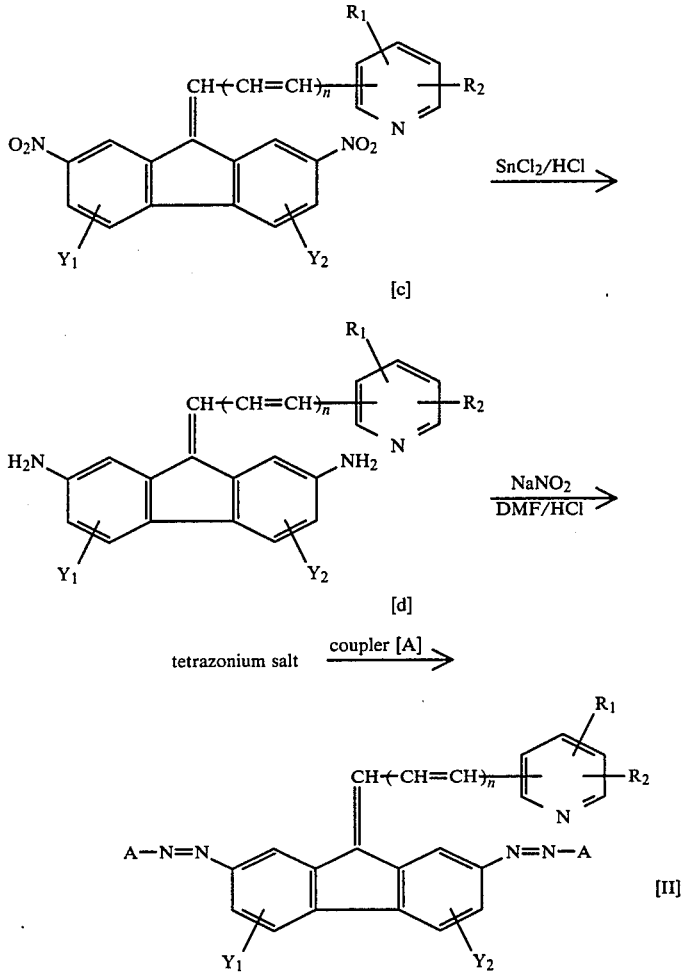

Synthesis examples of bis-azo pigments of the general formula [II] through the above route are described below.

SYNTHESIS EXAMPLES 4

[Pigment No. (39)]

5.1 g of 2,7-dinitrofluorene and 2.4 g of pyridine-4-aldehyde were mixed with 20 ml of ethyl alcohol and thereto was added 0.5 g of piperidine and then reaction was carried out in a sealed tube at 150°-160° C. over an oil bath for 2 hours. The reaction product was washed successively with ethyl alcohol and pyridine to obtain 5.8 g of an ocher powder. m.p. 349° C. (decomp.) (intermediate [C] $R_1=R_2=H$, $Y_1=Y_2=H$, n=0).

Then, 5.8 g of this dinitro compound was dispersed in 60 ml of acetic acid and thereto was added a solution prepared by dissolving 23 g of $SnCl_2.2H_2O$ in 50 ml of concentrated hydrochloric acid and reaction was carried out for 2 hours by stirring with heating to a bath temperature of 110°-120° C. to reduce the dinitro compound. After filtration, the separated product was made alkaline with an aqueous NaOH solution and thereafter, the precipitate was filtered off. This was subjected to extraction with DMF under heating. After DMF was distilled off, the residue was again subjected to extraction with ethyl acetate under heating. Then, ethyl acetate was distilled off to obtain a brown diamino compound powder of m.p. 240°-250° C. 0.285 g of this diamino compound was dissolved in 5 ml of DMF, followed by adding 0.6 ml of concentrated hydrochloric acid and 2 ml of water. Thereto was added dropwise, at lower than 0° C., a solution prepared by dissolving 0.145 g of $NaNO_2$ in 0.5 ml of water with stirring and reaction was carried out for one hour to obtain a tetrazonium salt.

Then, the above tetrazonium solution was added, with stirring under cooling, to a solution prepared by dissolving 0.76 g of coupler [A] of the following formula and 1.3 g of triethanolamine in 30 ml of DMF.

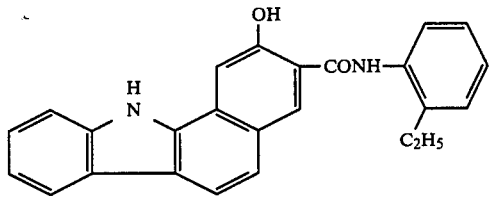

Reaction was continued for 5 hours and the produced pigment was filtered off, washed with water and then with acetone and DMF to obtain 0.63 g of the objective pigment. m.p. 320° C. (decomp.)

$H_2NCH_2CH_2NH_2$

λmax 620 nm

SYNTHESIS EXAMPLE 5

[Pigment No. (53)]

1.6 g of diamino compound was obtained in the same manner as in Synthesis Example 4 except that 3.0 g of

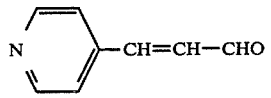

was used as a compound which was the starting material [b]. (intermediate [d] $R_1=R_2=H$, $Y_1=Y_2=H$, n=1) m.p. 247°–251° C. A brown powder.

In the same manner as in Synthesis Example 4, tetrazotization was effected using 0.31 g of the above diamino compound and the tetrazonium salt was reacted with the same coupler as used in Synthesis Example 4 to obtain the objective pigment, 0.90 g, m.p. 334° C. (decomp.)

$H_2NCH_2CH_2NH_2$

λmax 623 nm

SYNTHESIS EXAMPLE 6

[Pigment No. (64)]

(Synthesis of diamino base compound)

25.5 g (0.1 mol) of 2,7-dinitrofluorene and 13.3 g (0.11 mol) of 3-(4-pyridinyl)-2-propenal were suspended in 100 ml of ethanol and thereto were added several drops of piperidine, followed by refluxing under heating for 5 hours. After cooling by leaving as it was, the resulting crystal was filtered off and recrystallized from dimethylformamide to obtain a yellowish green needle crystal, 27.6 g.

Yield 74.4% m.p. 330° C. or higher.

A suspension of 18.6 g of thus obtained dinitro compound in 300 ml of dioxane was added to a solution of 10 ml of 50% acetic acid and 28 g of iron powder in 200 ml of dioxane, under refluxing with heating over a period of about one hour and then reaction was continued for 4 hours. Immediately after completion of the reaction, undissolved matter was removed and dioxane and others were removed under reduced pressure. The residue was recrystallized from ethyl acetate to obtain 13.2 g of a red needle crystal.

Yield 84.6% m.p. 247.5°–250.5° C.

(Synthesis of coupler compound)

100 g (0.436 mol) of 3,5-di-(trifluoromethyl)aniline and 100 g (0.4 mol) of 2-hydroxy-3-phenylnaphthoate were stirred for 10 hours in an oil bath of 170° C. and after cooling by leaving as it was, the resulting solid reaction product was thoroughly powdered in 1 l of ethanol. Then, the product was recrystallized from ethyl acetate to obtain 98.5 g of a yellowish white powder.

Yield 61.7% m.p. 237°–238.5° C.

(Synthesis of bis-azo pigment)

3.1 g (0.01 mol) of the diamino base compound obtained above, 30 ml of concentrated hydrochloric acid and 30 ml of water were mixed and thereto was added dropwise, with stirring at lower than 0° C., a solution prepared by dissolving 1.5 g of sodium nitrite in 10 ml of water. After completion of the addition, stirring was effected for another 30 minutes and undissolved matter was removed. This tetrazonium solution kept at lower than 5° C. was added dropwise to a solution prepared by dissolving 8.1 g of the coupler compound obtained above and 18.0 g of triethanolamine in 200 ml of dimethylformamide over a period of about 20 minutes. Then, this was stirred for 3 hours at room temperature. After completion of the reaction, a crystallized blackish green powder was filtered off and washed with DMF and then with water to obtain 9.6 g of azo pigment No. (64).

Yield 82.8% m.p. 338° C. (decomp.)

Typical examples of the pigments represented by the general formulas [I] and [II] are shown below.

(I) Examples of the bis-azo pigments represented by the general formula [I].

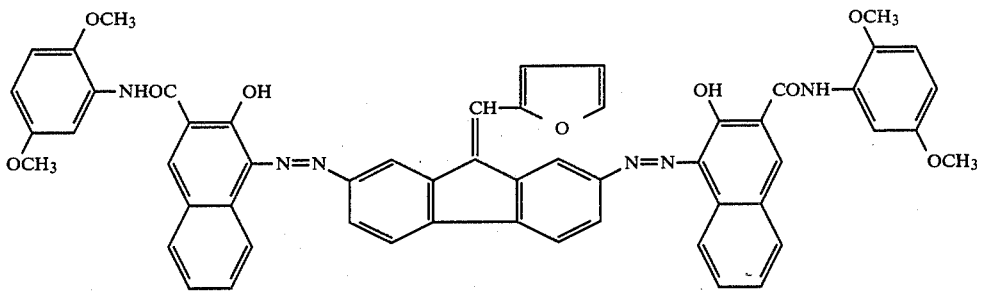

(1)

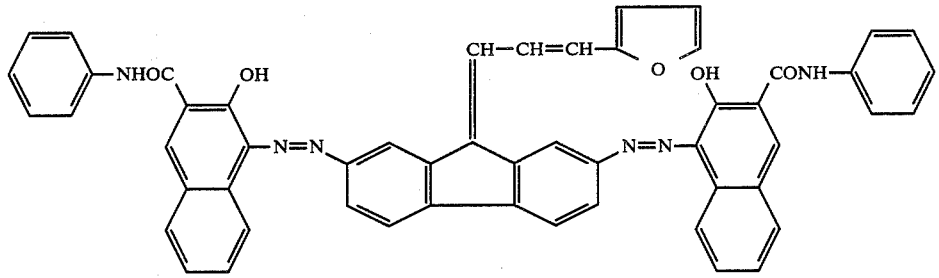

(2)

-continued
(3)
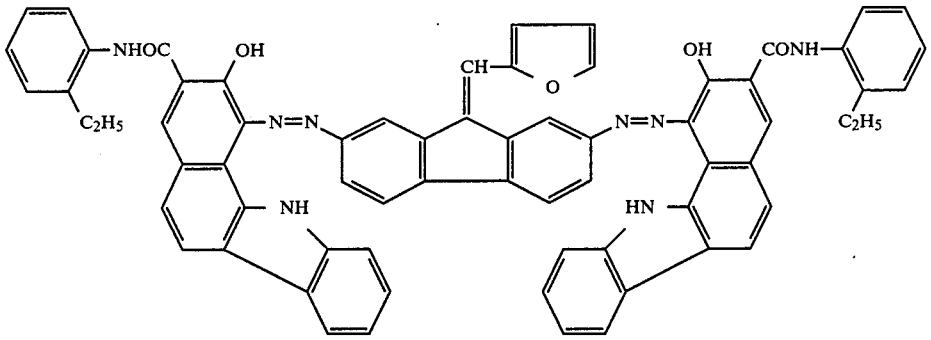
(4)
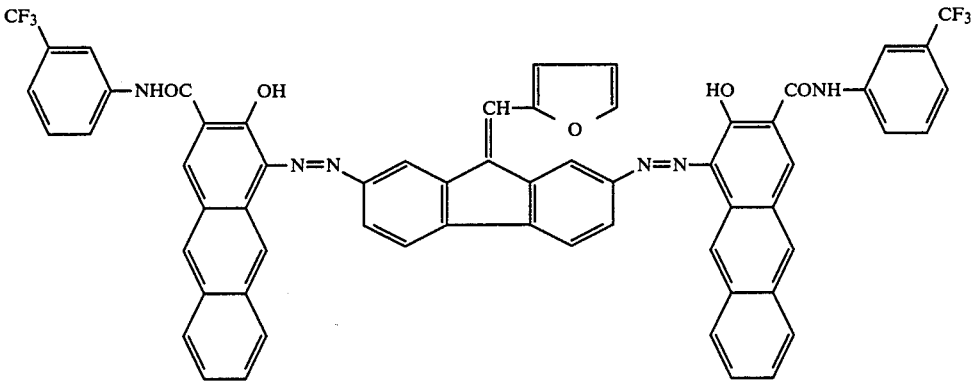
(5)
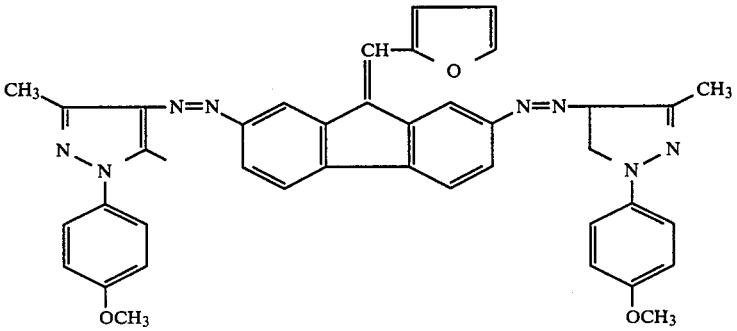
(6)
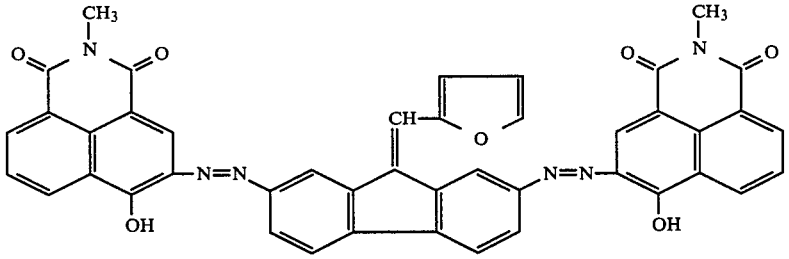
(7)
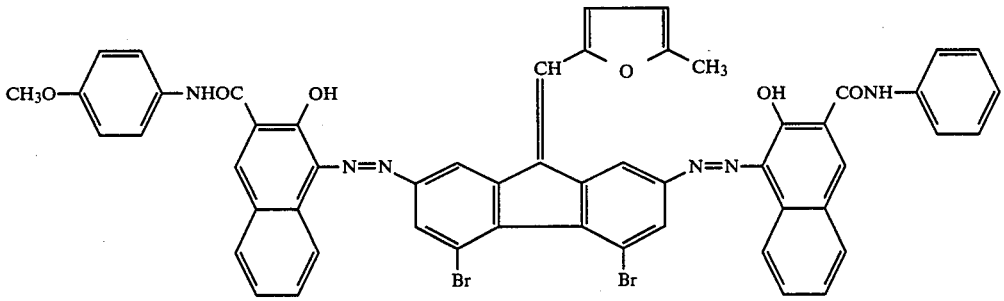

-continued
(8)
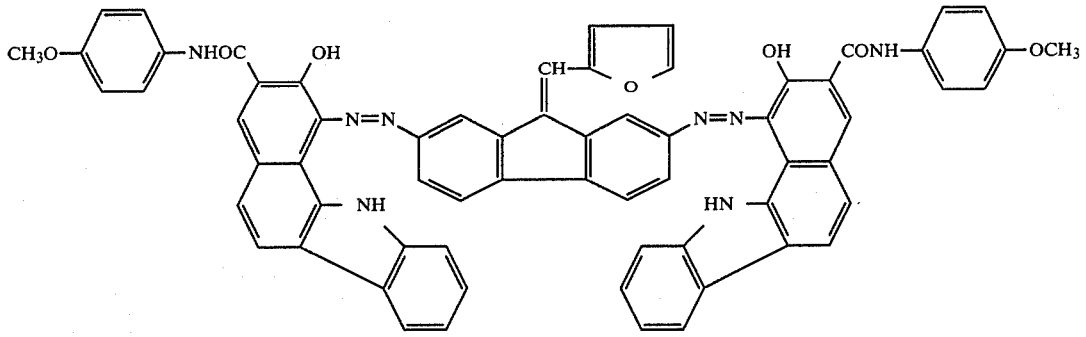
(9)
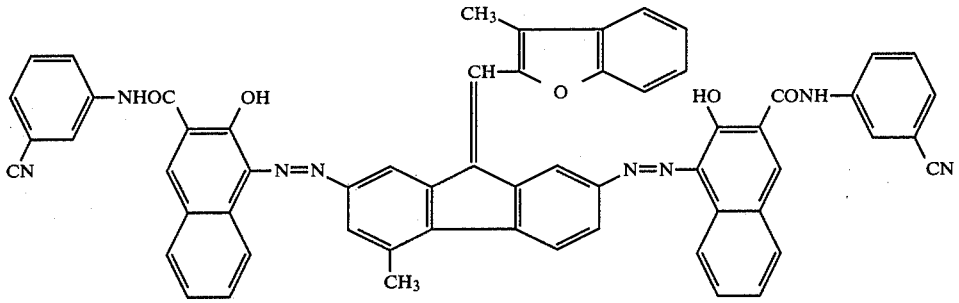
(10)
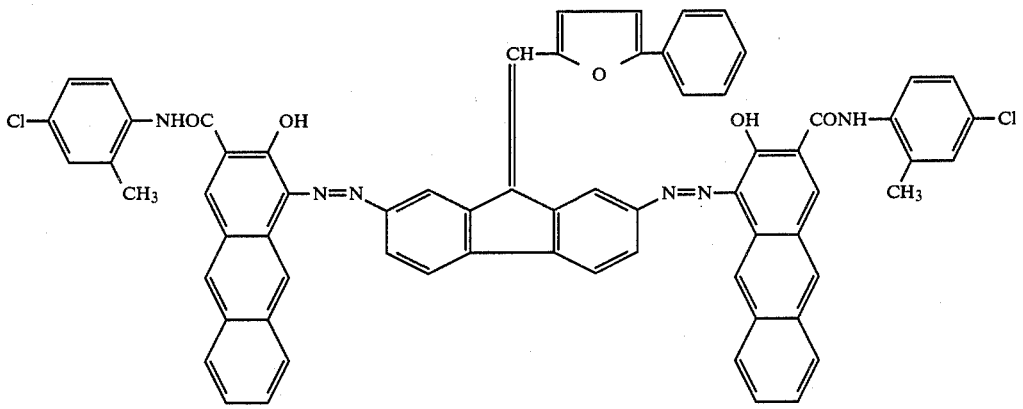
(11)
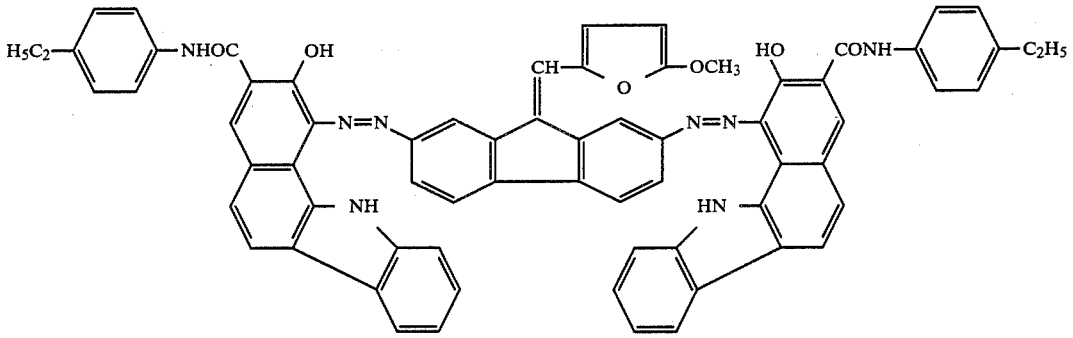

-continued
(12)
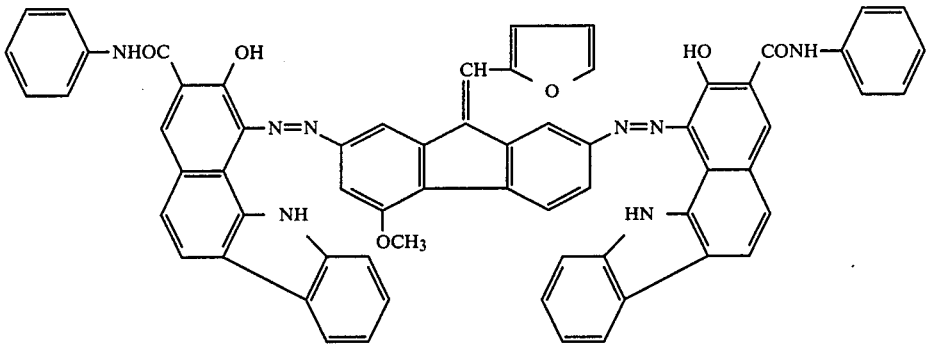
(13)
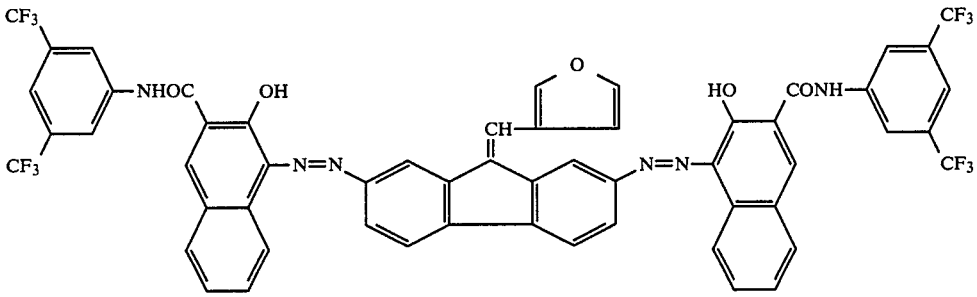
(14)
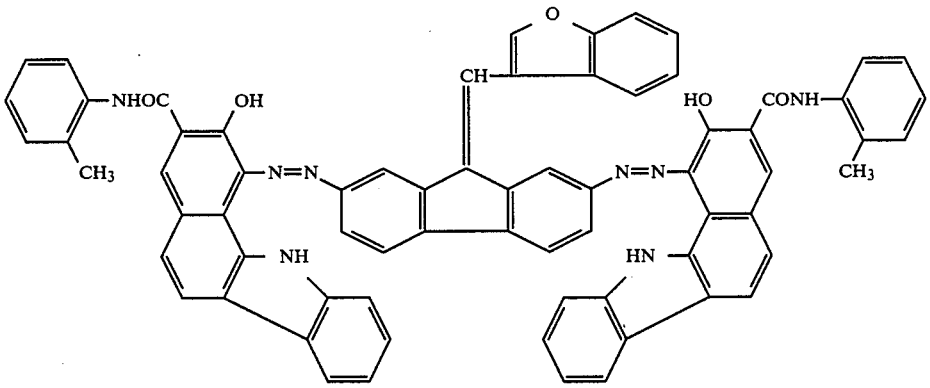
(15)
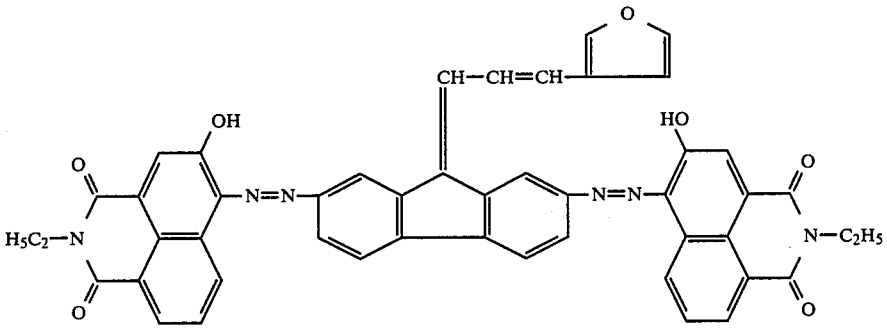
(16)
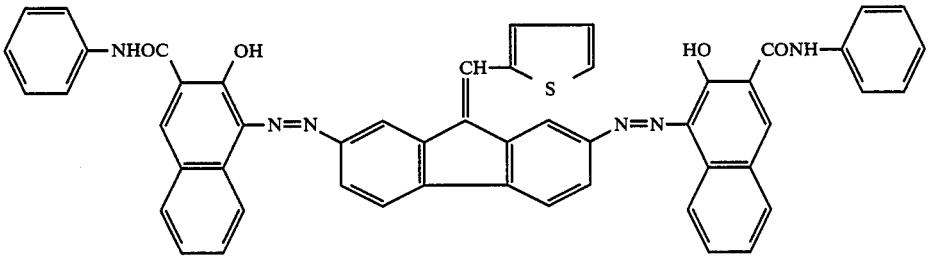

-continued
(17)
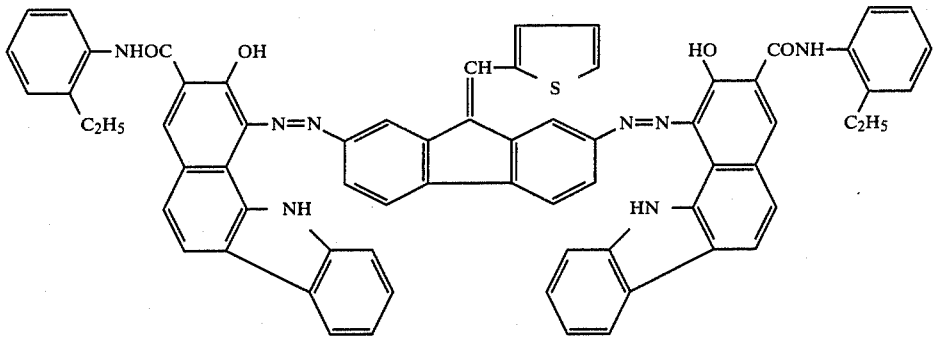
(18)
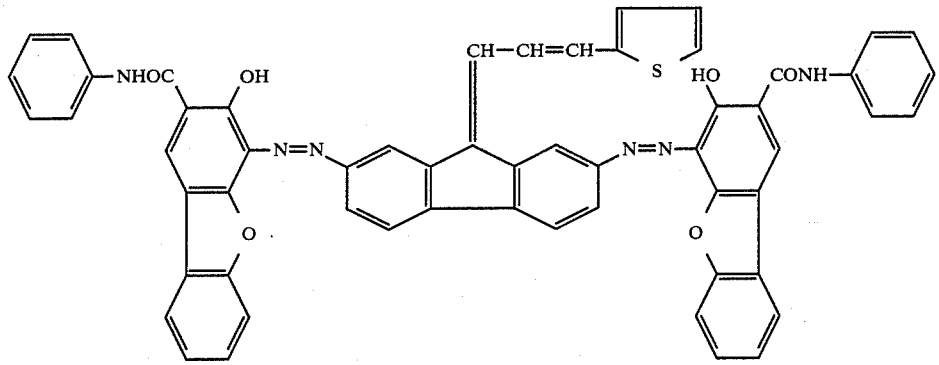
(19)
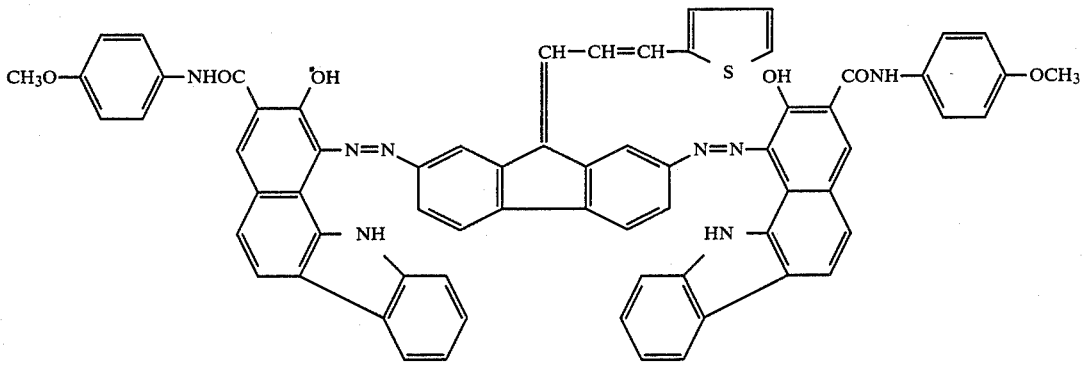
(20)
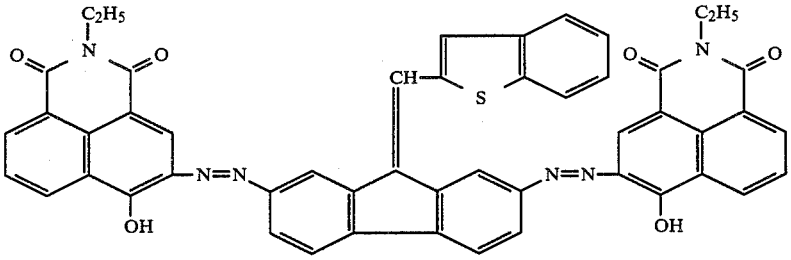

-continued
(21)
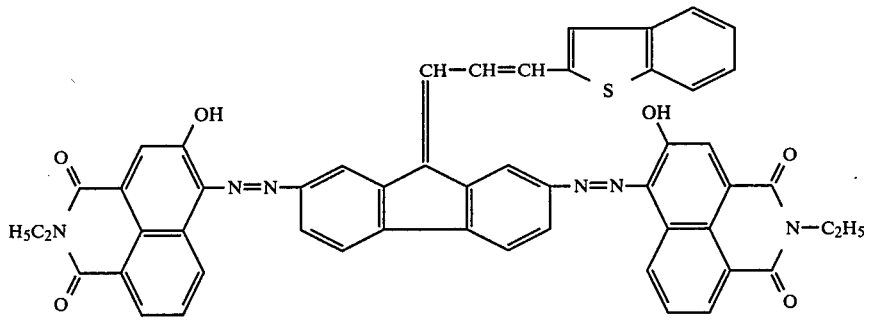
(22)
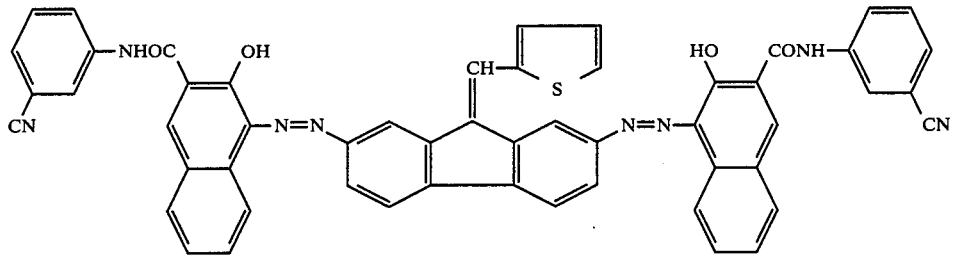
(23)
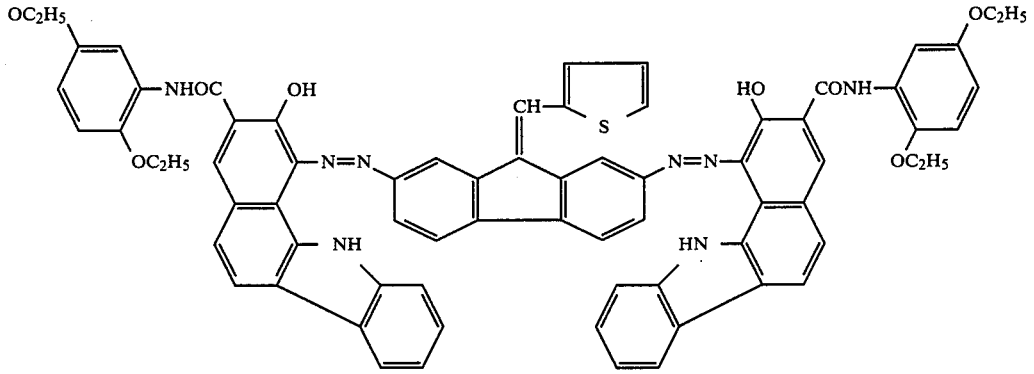
(24)
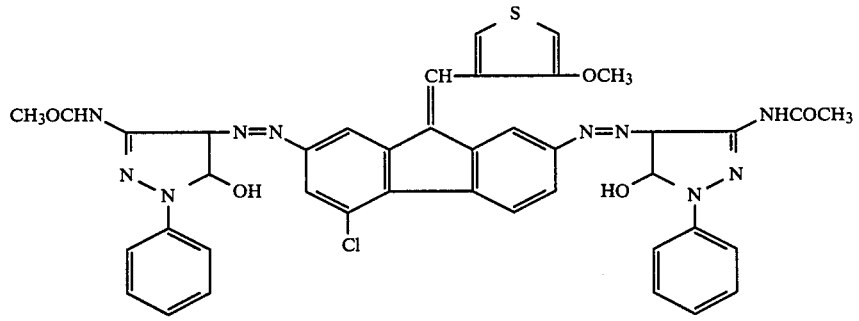

-continued
(25)
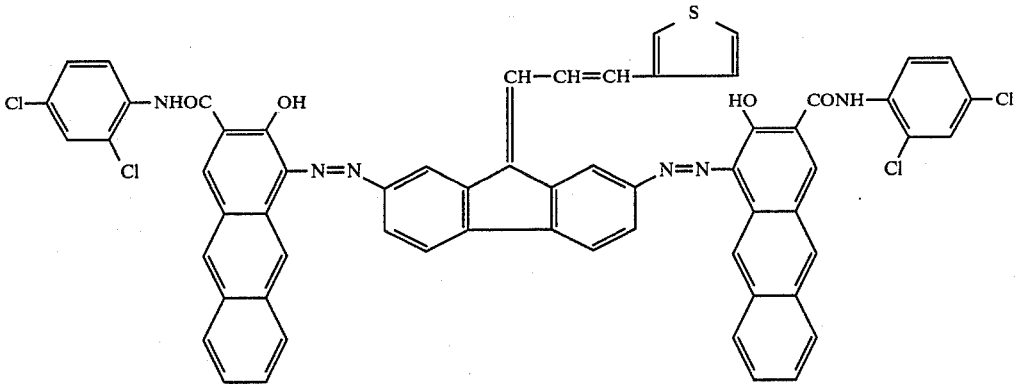
(26)
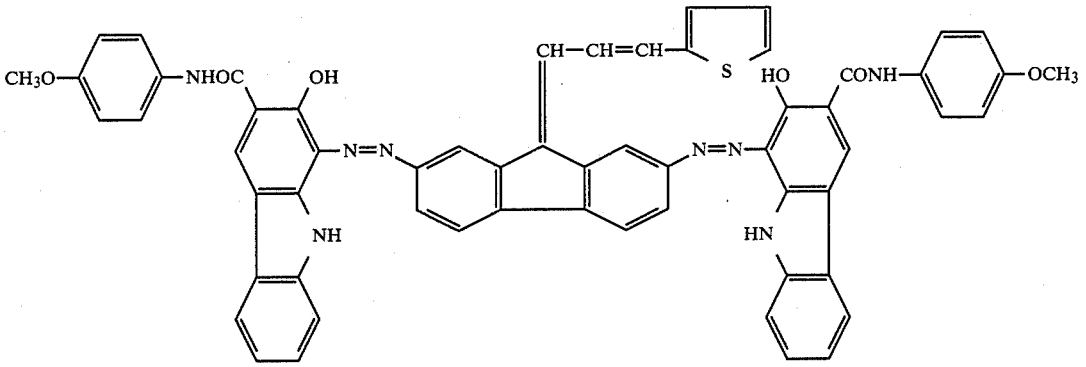
(27)
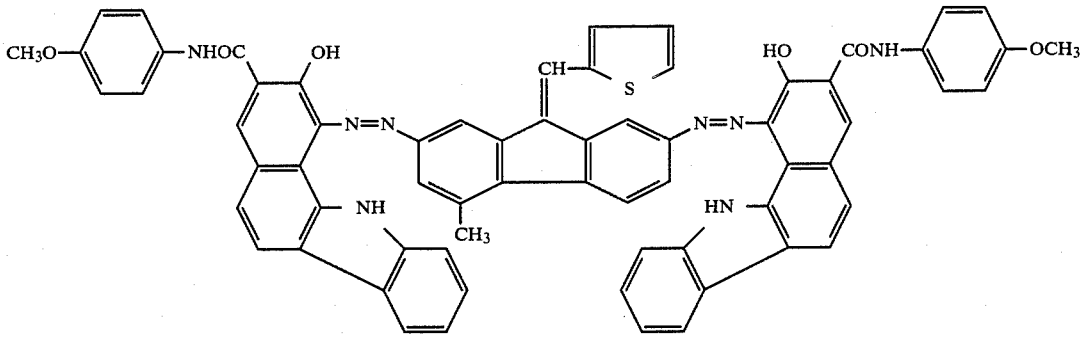
(28)
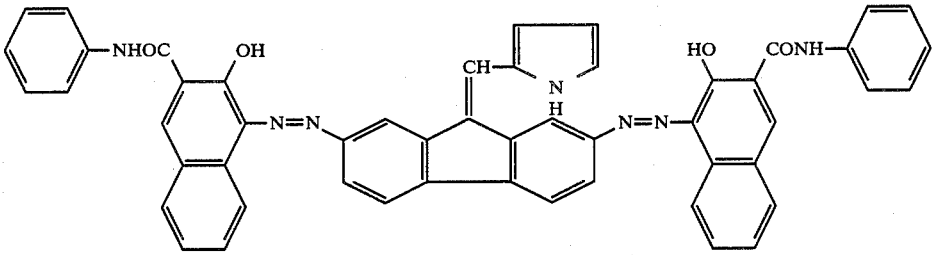

-continued
(29)
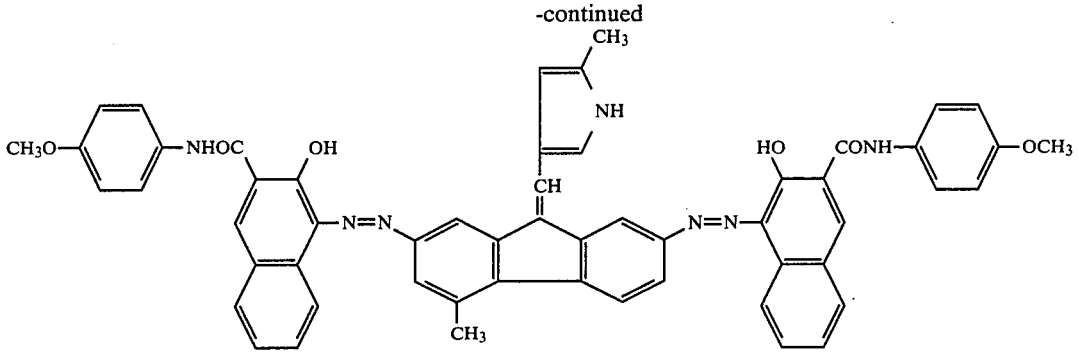
(30)
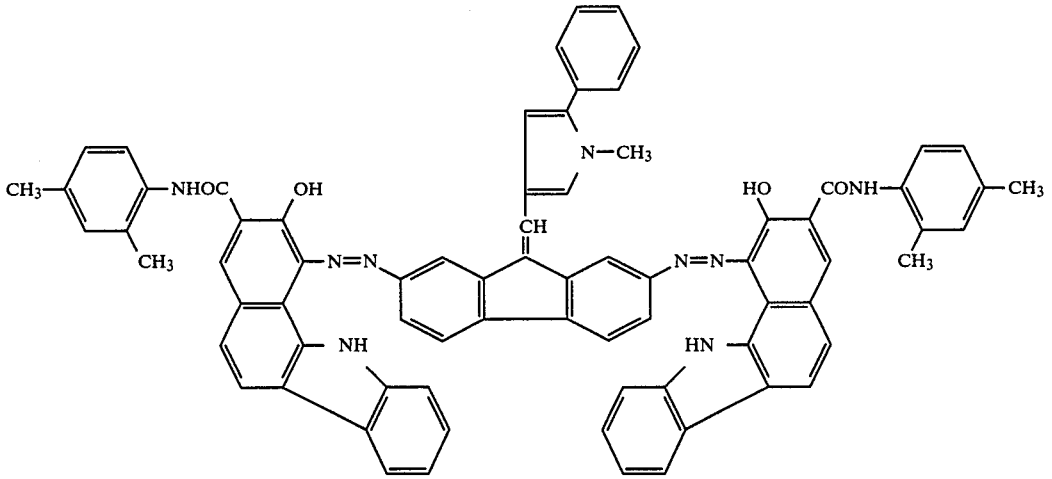
(31)
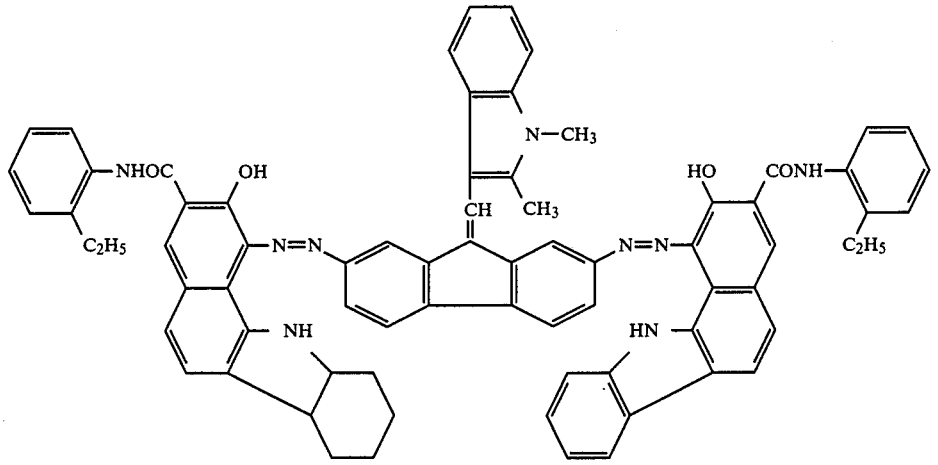
(32)
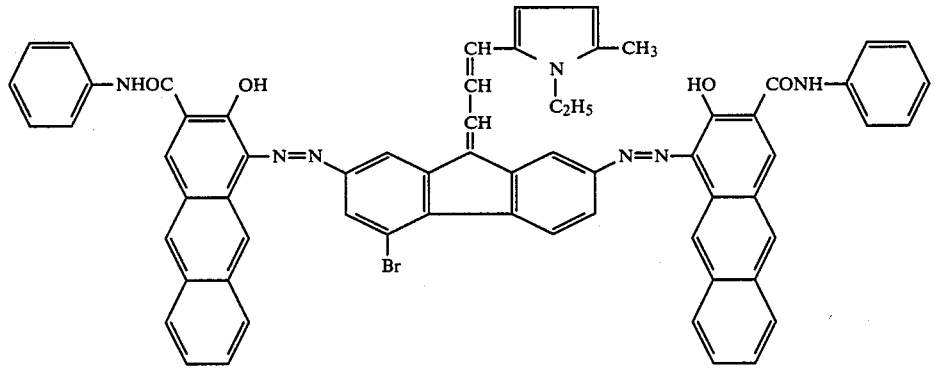

-continued
(33)
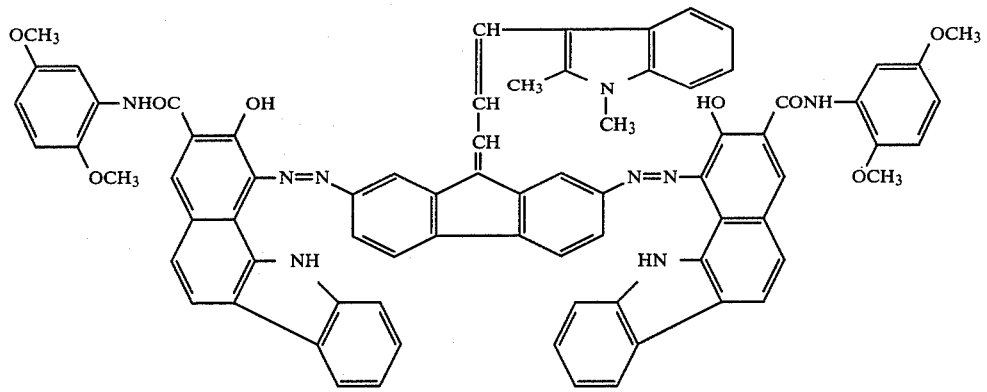
(34)
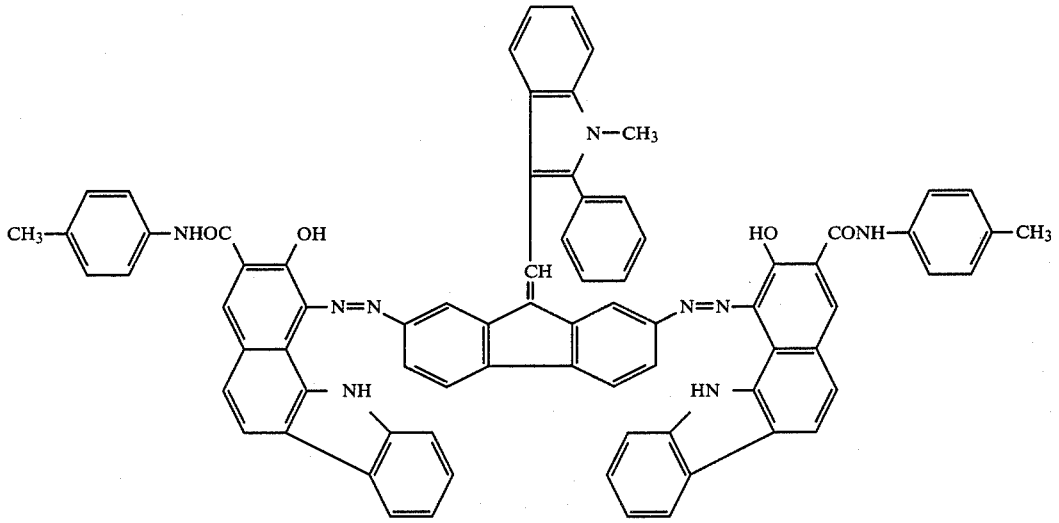
(35)
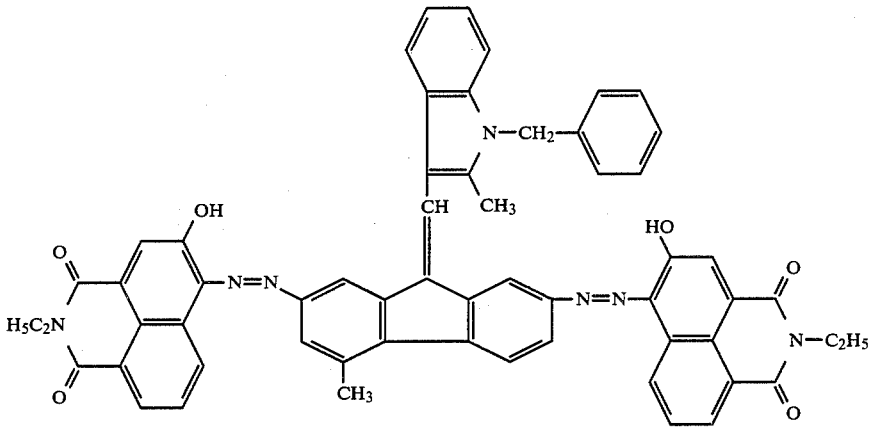

-continued
(36)
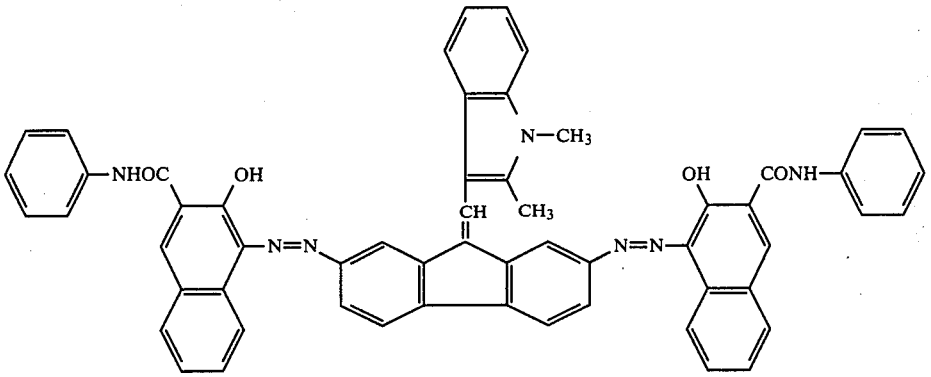
(II) Examples of the bis-azo pigments represented by the general formula [II].
(37)
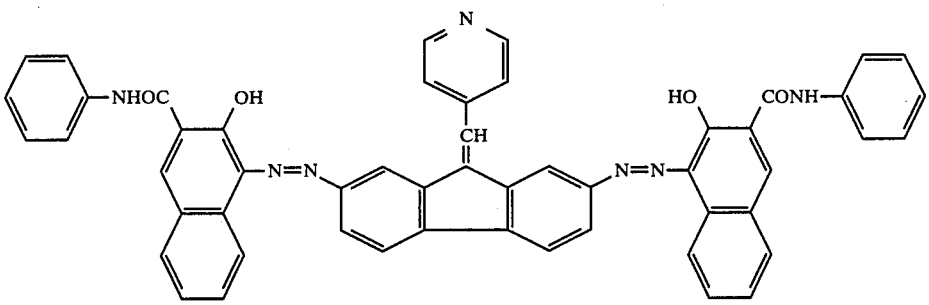
(38)
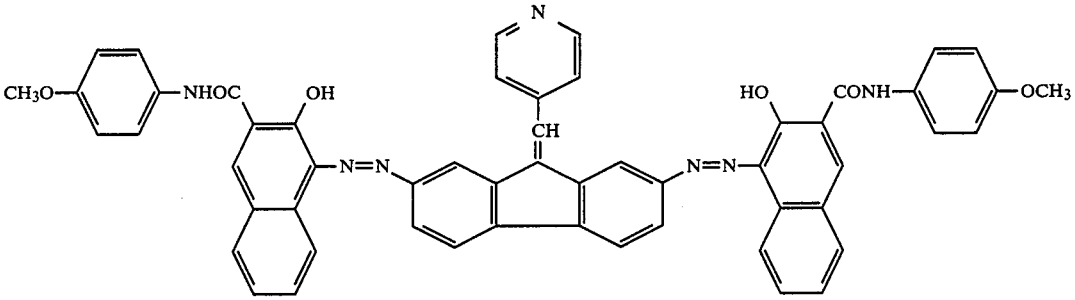
(39)
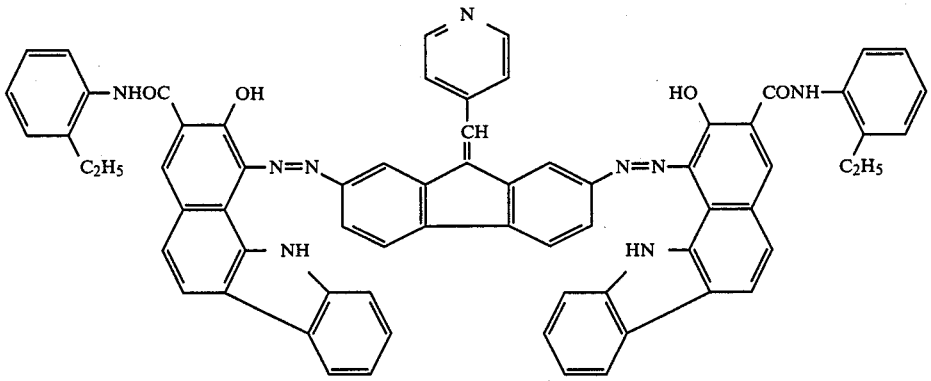

-continued
(40)
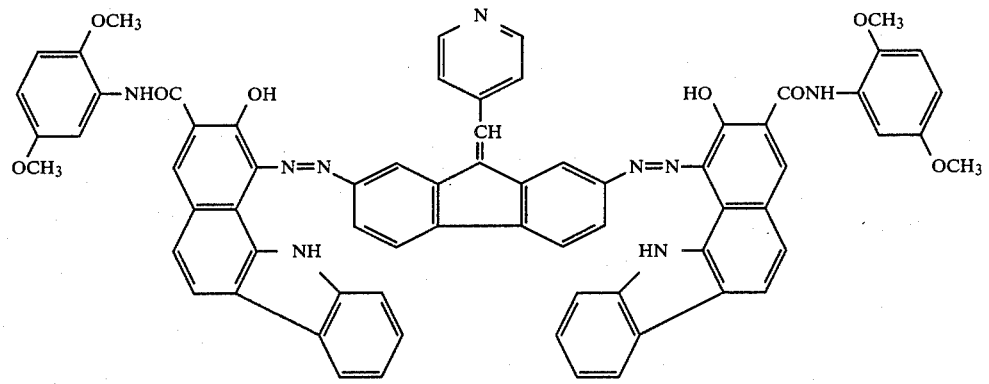
(41)
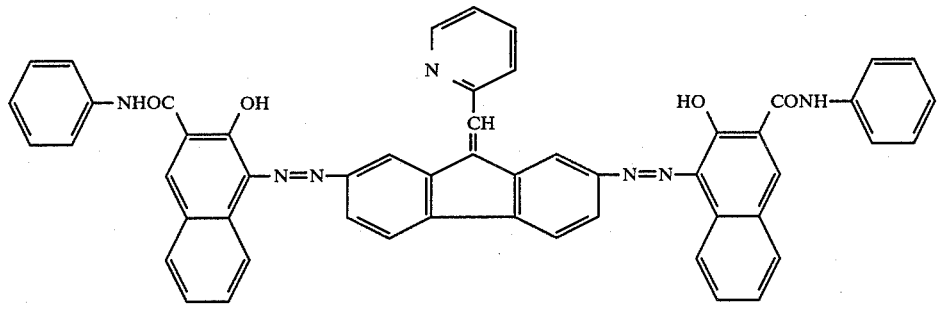
(42)
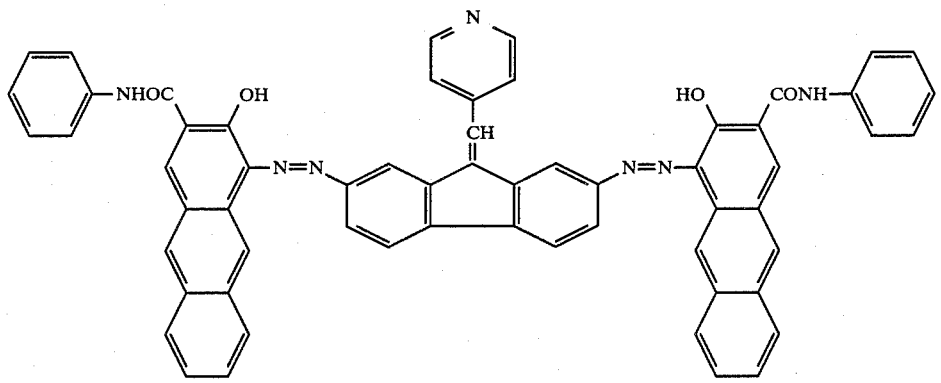
(43)
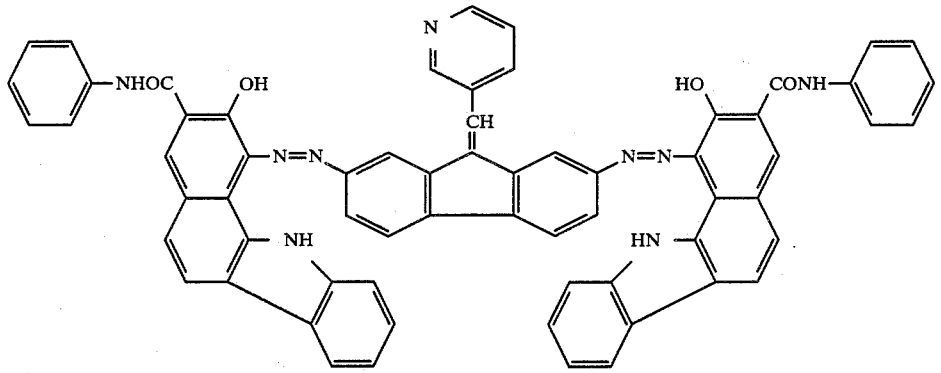

-continued
(44)
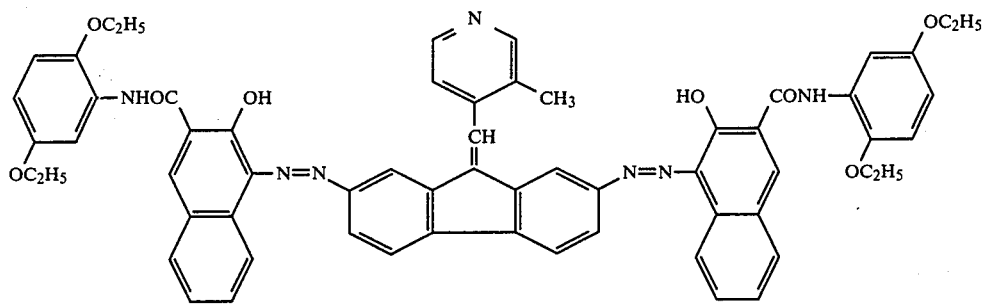
(45)
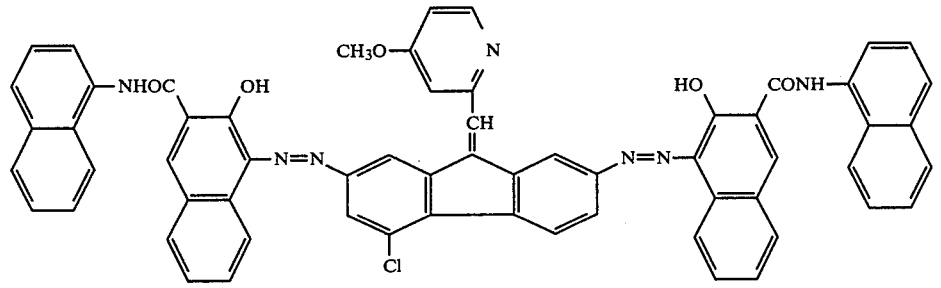
(46)
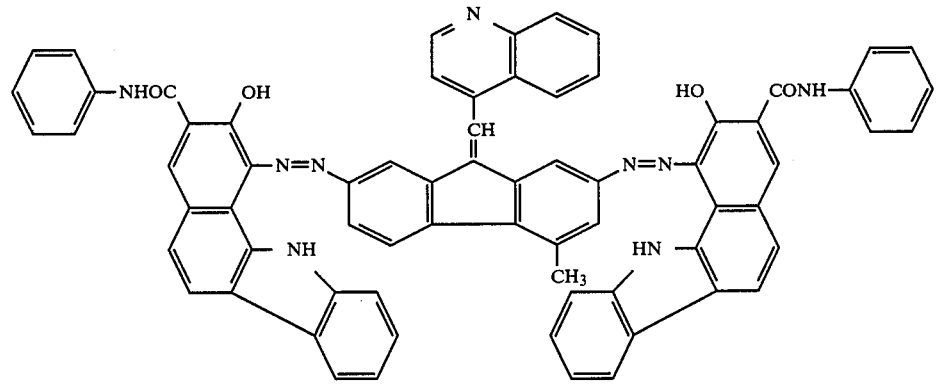
(47)
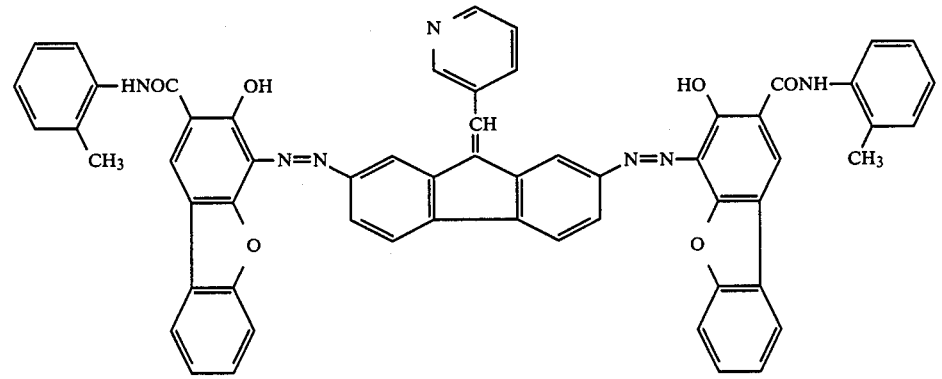

-continued
(48)
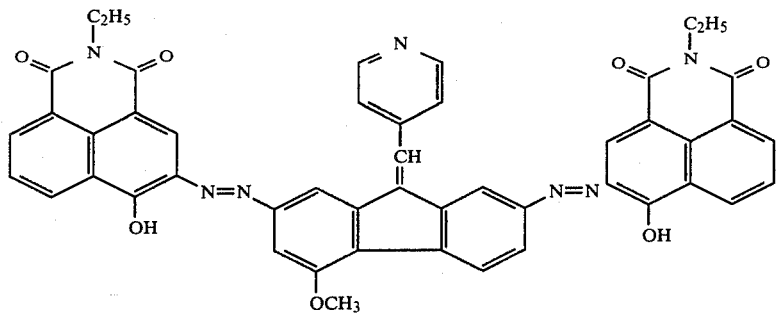
(49)
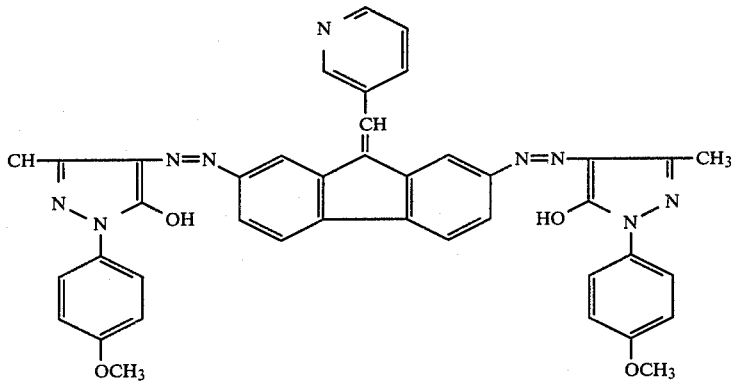
(50)
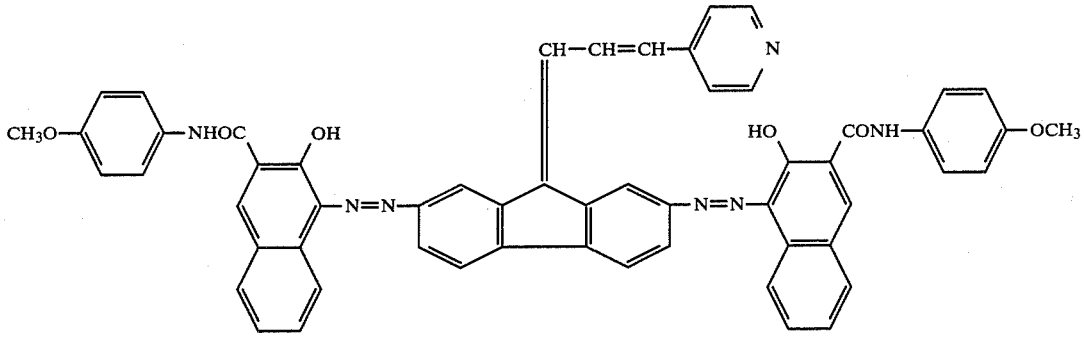
(51)
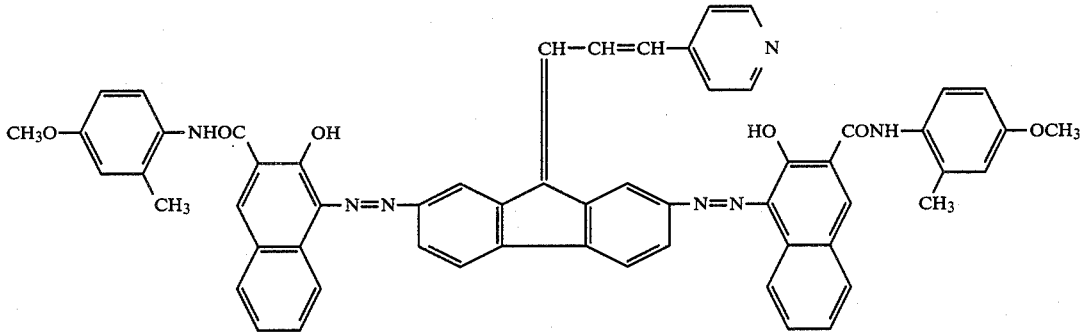

-continued
(52)
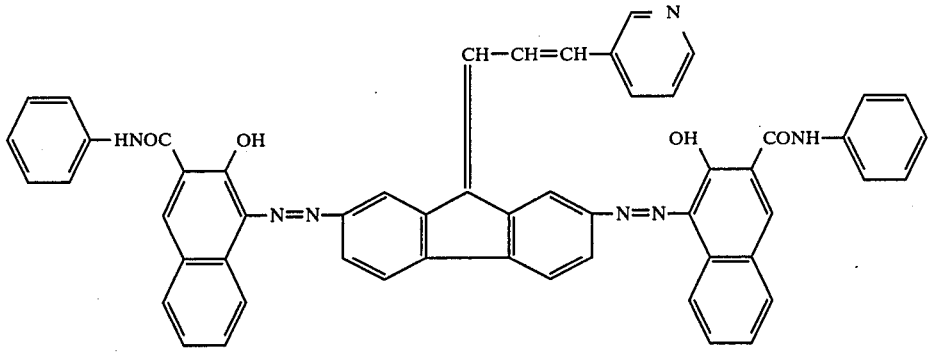
(53)
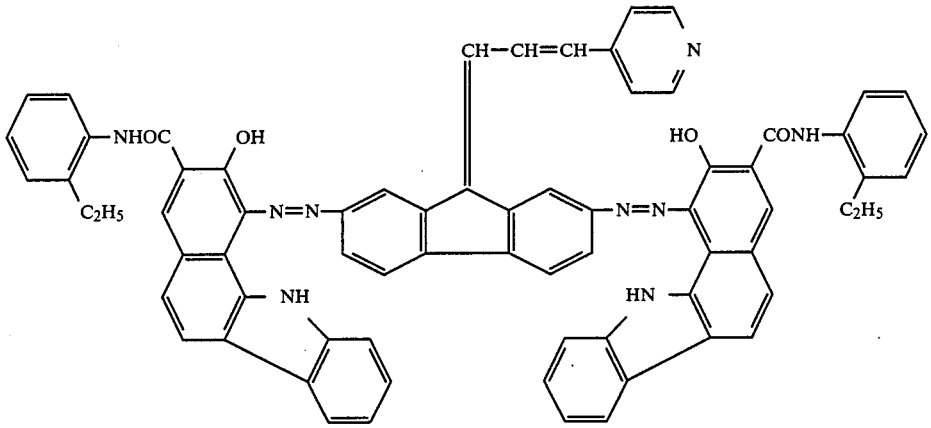
(54)
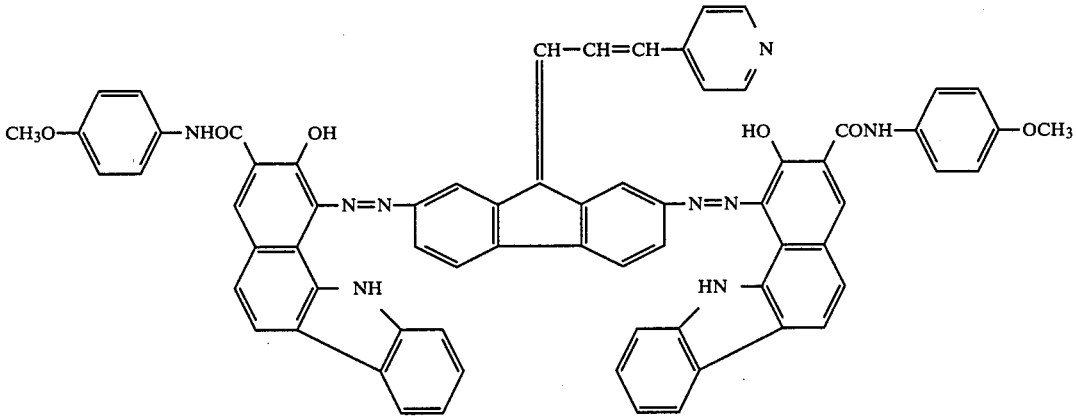
(55)
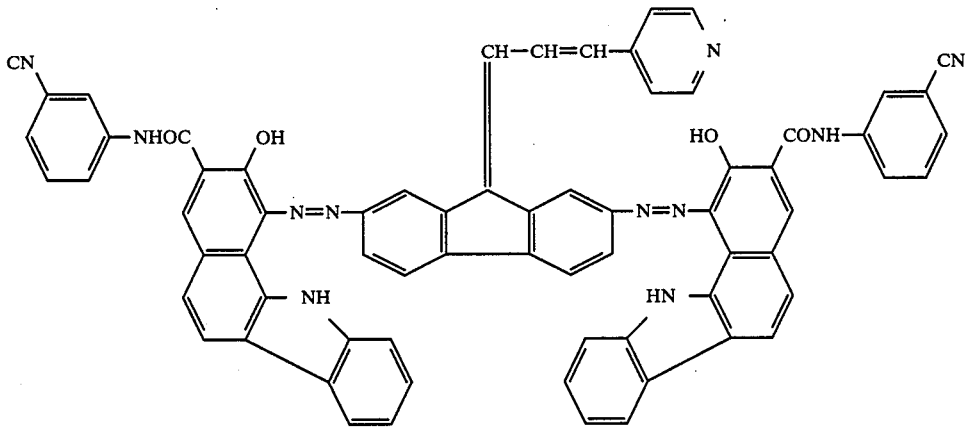

-continued
(56)
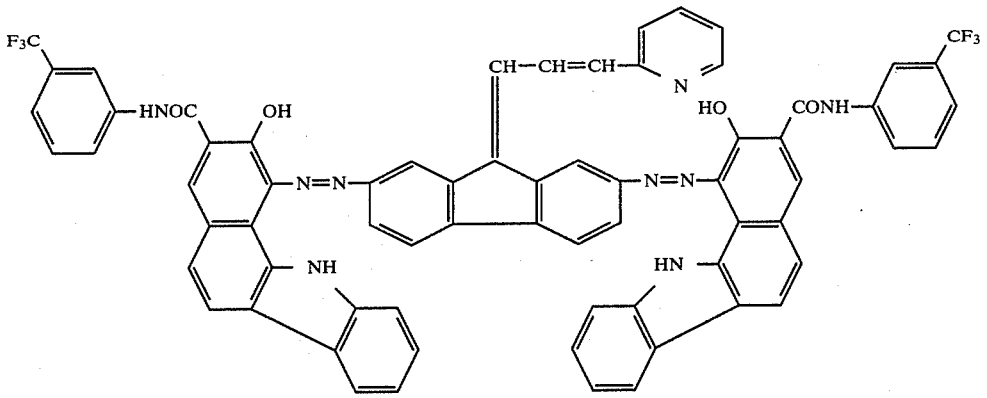
(57)
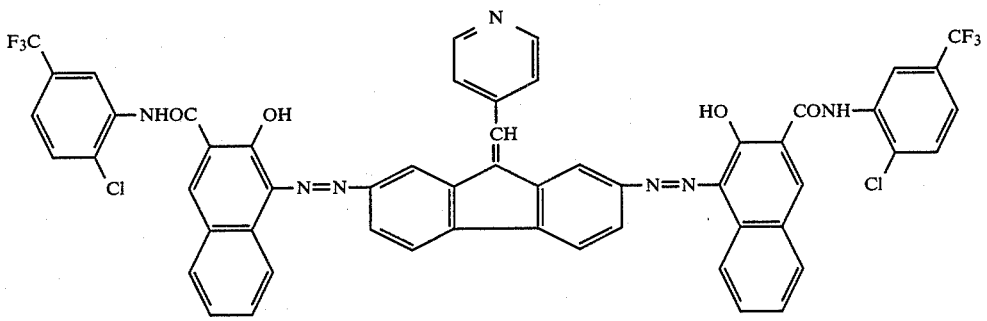
(58)
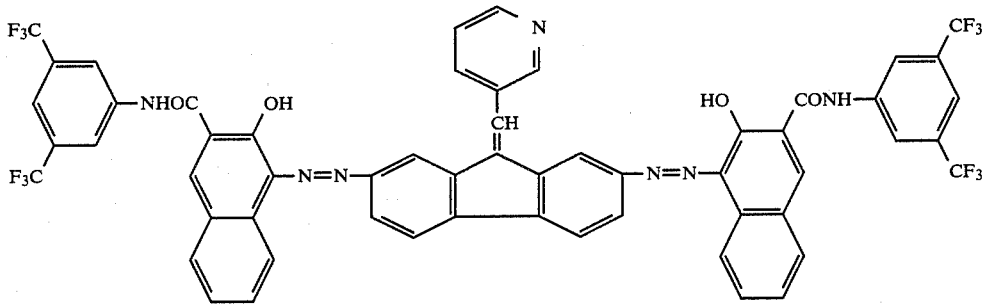
(59)
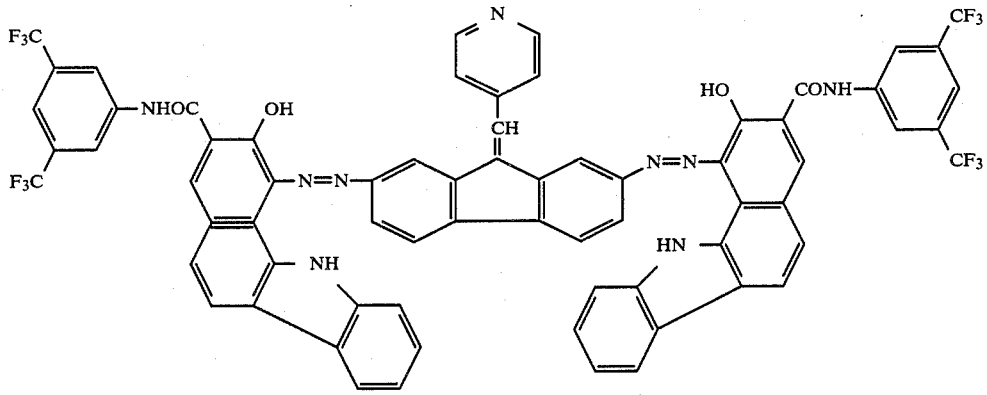

-continued
(60)
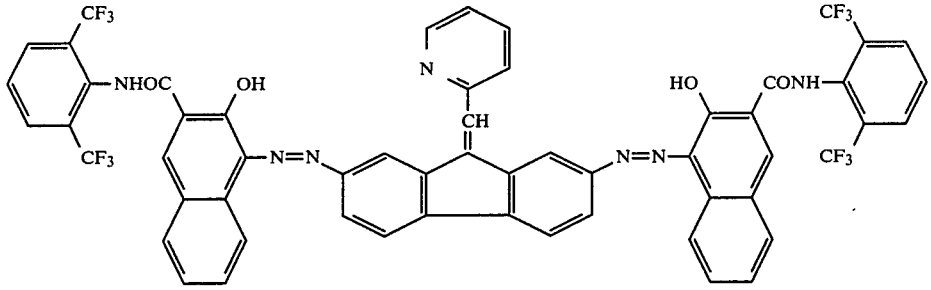
(61)
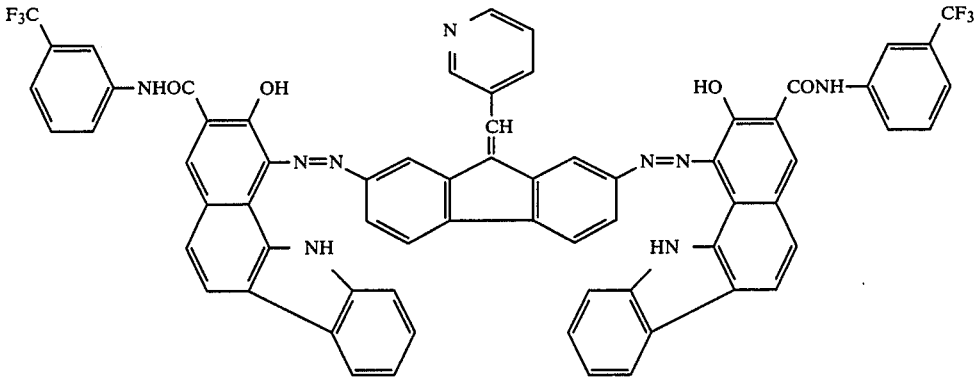
(62)
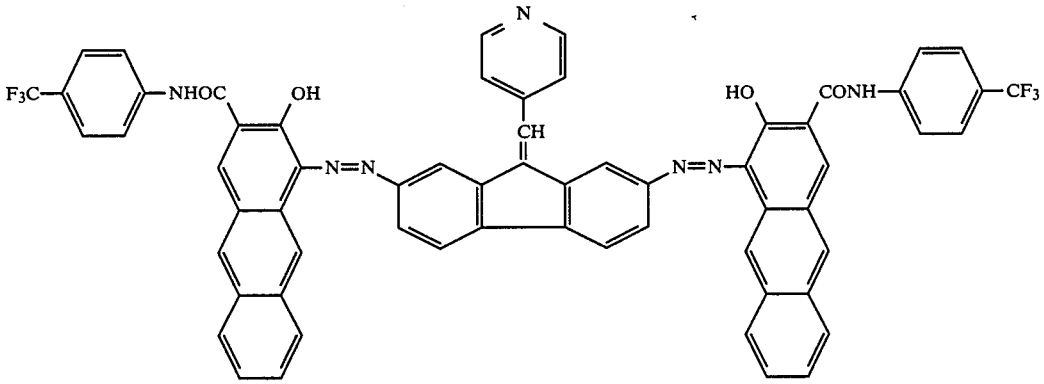
(63)
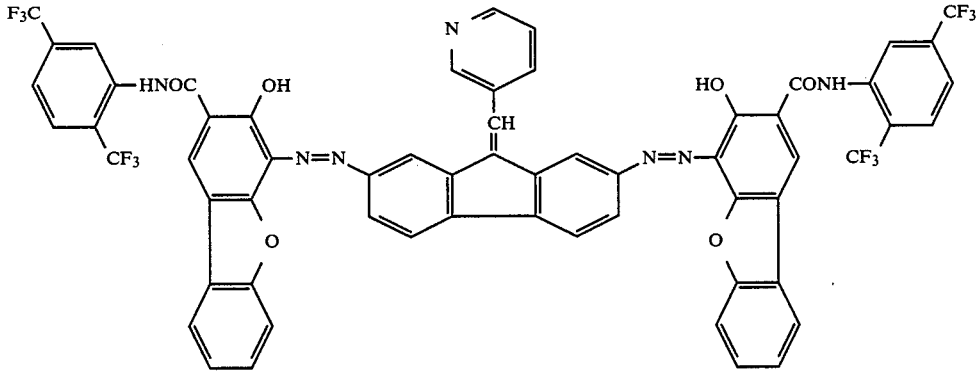

-continued
(64)
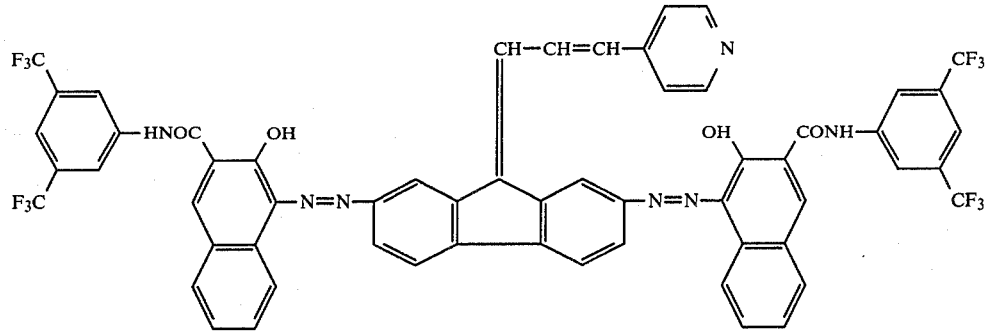
(65)
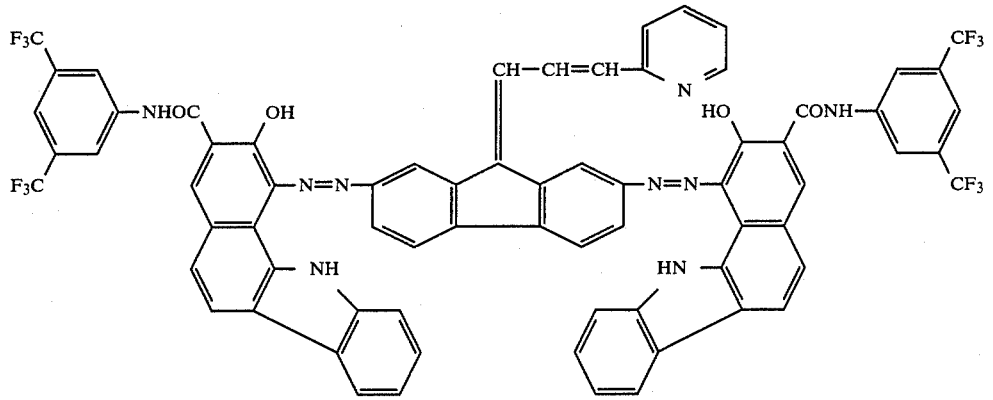
(66)
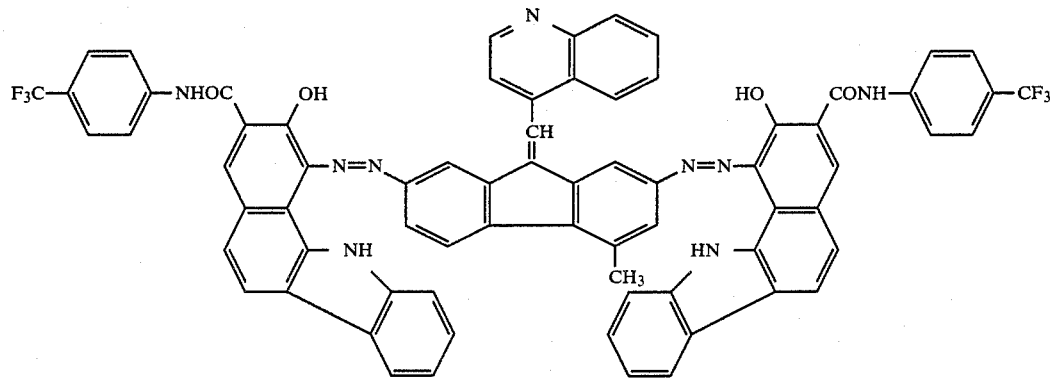
(67)
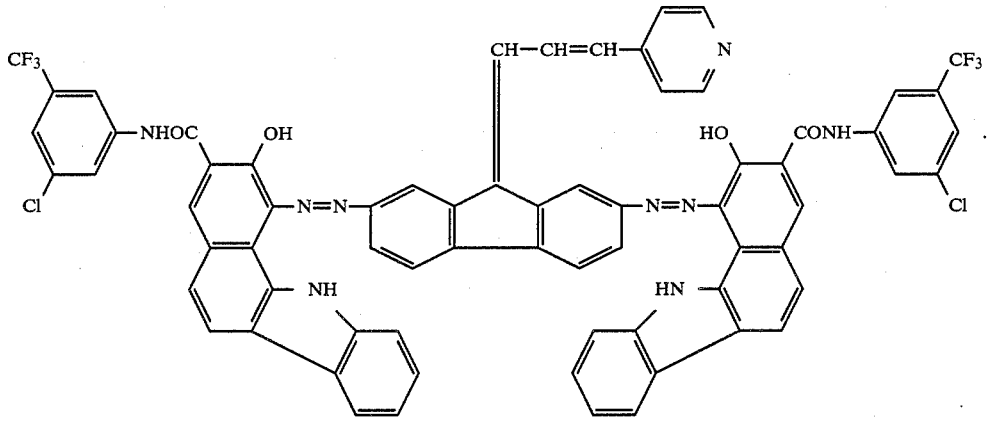
The electrophotographic photoreceptor of this invention has a light-sensitive layer containing the bis-azo pigment represented by the generla formula [I] or [II] and the bis-azo pigment may be used in various manners. For example, a dispersion of the bis-azo pigment in a binder is coated on a conductive support to form the photoconductive layer. Amount of the azo pigment is 0.05–2, preferably 0.1–1 time the weight of the binder. Furthermore, in another embodiment, the bis-azo pigment is dispersed as a charge generator in a charge transport substance and this dispersion mixture was coated on a conductive support to form a light-sensitive layer.

In still another embodiment, a charge generating layer containing the bis-azo pigment as a charge generator is provided on a conductive support and a charge transport layer is provided thereon to form a laminate photoreceptor. In this case, the charge generating layer may be formed by vapor deposition of the azo pigment on a conductive support or by coating a dispersion of the azo pigment in a binder resin.

As examples of the binder resins used for dispersion of the charge generator in the above embodiments, mention may be made of polyester resins, acrylic resins, styrene resins, silicone resins, alkyd resins, vinyl chloride-vinyl acetate copolymer resins, styrene-butadiene copolymer resins, polyvinl acetal resins, diallyl phthalate resins, polysulfone resins, polycarbonate resins, vinyl acetate-crotonic acid copolymer resins, polyarylate resins, butyral resins, styrene-maleic anhydride copolymer resins, rosin-phenol modified resins, casein, etc. These may be used alone or in admixture of two or more as copolymers. These binders may be used in an amount of 0.1–5, preferably 0.2–3 times the weight of the bis-azo pigment.

As the charge transport substances which form the charge transport layer, there may be used known conductive compounds. For example, as positive hole transport substances, mention may be made of polyvinylcarbazole, phenanthrene, N-ethylcarbazole, 2,5-oxadiazole, 4,4'-bis(diethylamino)-2,2'-dimethyltriphenylmethane, 2,4,5-tri(p-diethylaminophenyl)oxazole, 2,5-bis(p-diethylaminophenyl)-1,3,4-triazole, 1-phenyl-3-(p-diethylaminostyryl)-5-(p-diethylaminophenyl9-2-pyrazoline, p-diethylaminobenzaldehyde-diphenylhydrazone, N-ethyl-carbazole-3-carboxaldehydediphenylhydrazone, etc. As electron transport substances, mention may be made of 2-nitro-9-fluoroenone, 2,7-dintro-9-fluorenone, 2,4,7-trinitro-9-fluorenone, 2-nitrobenzothiophene, dinitroanthracene, dinitroacridine, dinitroanthraquinone, etc.

These charge transport substances may be used by dispersing or dissolving in binder resins. As the binder resins, there may be used those mentioned hereinbefore. The binder may be used in an amount of 0.1–10, preferably 0.2–5 times the weight of the charge transport substance.

The conductive supports used for making the photoreceptor of this invention include a metal sheet, a conductive paper, a conductivity imparted plastic film, a deposited metal film, a metal cylinder, a metal deposited or metallic foil applied plastic cylinder, etc. As solvents used for coating a dispersion or solution of the azo pigment or the charge transport substance on the support, mention may be made of toluene, xylene, monochlorobenzene, chloroform, dichloroethane, trichloroethylene, methylene chloride, dioxane, tetrahydrofuran, ethyl acetate, butyl acetate, methyl cellosolve, methyl cellosolve acetate, cyclohexanone, methyl ethyl ketone, dimethylformamide, dimethyl sulfoxide, ethyl alcohol, propyl alcohol, butyl alcohol, etc.

The following examples further illustrate this invention.

EXAMPLE 1

One part by weight of pigment No. (3) enumerated hereinbefore and one part by weight of a polyester resin (Bylon-200 of Toyobo Co.) were mixed with 100 parts by weight of tetrahydrofuran and the mixture was dispersed together with glass beads by a paint conditioner for 2 hours. Thus obtained pigment dispersion was coated on a support comprising a polyester film clad with an aluminum foil by a wire bar. Thickness of the coating was 0.2μ.

Then, on this charge generating layer was coated a coating composition prepared by dissolving 1 part by weight of p-diethylaminobenzaldehyde-diphenylhydrazone as a charge transport substance and 1 part by weight of a polycarbonate resin in 10 parts by weight of dichloroethane by a wire bar to provide a charge transport layer of 15μ thick.

Thus produced laminate photoreceptor was electrostatically charged by subjecting it to corona discharge of −6 KV in the dark and the initial potential ($V_0$) was measured by an electrostatic paper testing apparatus (SP-428 of Kawaguchi Denki Co.). Then, this charged photoreceptor was exposed with a white light, the illuminance on the surface being 5 lux, and time (second) necessary to decay the surface initial potential to one-half was measured and half decay exposure (E ½) was determined as sensitivity. The sensitivity E ½ of this photoreceptor was 3.5 lux.second.

EXAMPLES 2–6

One part by weight of each of pigment No. (1), (4), (19), (22) and (36) and 1 part by weight of a polyarylate resin (U-100 of Unitika Ltd.) were mixed with 100 parts by weight of dichloroethane and the mixture was dispersed in the same manner as in Example 1 to obtain a coating dispersion. In the same manner as in Example 1, the dispersion was coated on an anodized aluminum support for PS plate (Agfa-Gebaert AG) to provide a charge generating layer of about 0.2–0.3μ thick.

Then, on said charge generating layer was coated a coating composition prepared by dissolving 1 part by weight of p-dibenzyl aminobenzaldehyde-diphenylhdrazone as a charge transport substance and 1 part by weight of the polyarylate resin in 10 parts by weight of dichloroethane in the same manner as in Example 1 to provide a charge transport layer of about 15μ thick. Thus obtained laminate photoreceptor was tested in the same manner as in Example 1 and the results are shown in Table 1.

TABLE 1

| Example | Pigment No. | Vo | E ½ |
|---|---|---|---|
| 2 | (1) | −923 V | 3.9 lux · sec. |
| 3 | (4) | −910 | 4.0 lux · sec. |
| 4 | (19) | −725 | 4.6 lux · sec. |
| 5 | (22) | −845 | 3.5 lux · sec. |
| 6 | (36) | −956 | 4.1 lux · sec. |

For comparison, a photoreceptor was produced in the same manner as above except that a pigment of the following formula was used.

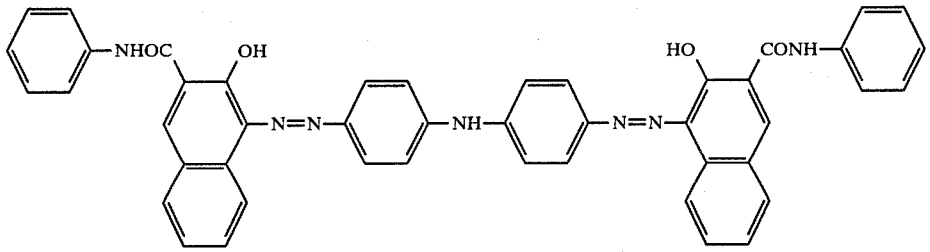

Thus obtained photoreceptor had a Vo of −630 V and an E ½ of 8.3 lux.sec.

EXAMPLES 7–11

Two parts by weight of each of pigments No. (8), (16), (17), (23) and (26) and 1 part by weight of a polycarbonate resin (Pan-lite-1250 of Teiji Chemical Co.) were added to 50 parts by weight of dichloroethane and dispersion was carried out for 2 hours by a paint conditioner. This dispersion was coated on the surface of an aluminum cylinder of 60 mm in outer diameter by cylinder drawing-up coating method. Thickness of this layer was about 0.5μ. On this charge generating layer was coated a coating composition prepared by dissolving 1 part by weight of 1-phenyl-3-(p-diethylaminostyryl)-5-(p-diethylaminophenyl)pyrazoline and 2 parts by weight of a polyester resin (Bylon-200) in 25 parts by weight of dichloroethane to form a charge transport layer 15μ thick. Thus obtained cylinder photoreceptor was tested for sensitivity and the results are shown in Table 2.

TABLE 2

| Example | Pigment No. | Vo | E ½ |
|---|---|---|---|
| 7 | (8) | −962 V | 4.5 lux · sec. |
| 8 | (16) | −874 | 6.1 lux · sec. |
| 9 | (17) | −869 | 4.8 lux · sec. |
| 10 | (23) | −903 | 5.3 lux · sec. |
| 11 | (26) | −955 | 7.4 lux · sec. |

For comparison, a photoreceptor was produced in the same manner as above except that a pigment of the following formula was used. This photoreceptor had a Vo of −582 V and an E ½ of 12 lux.sec.

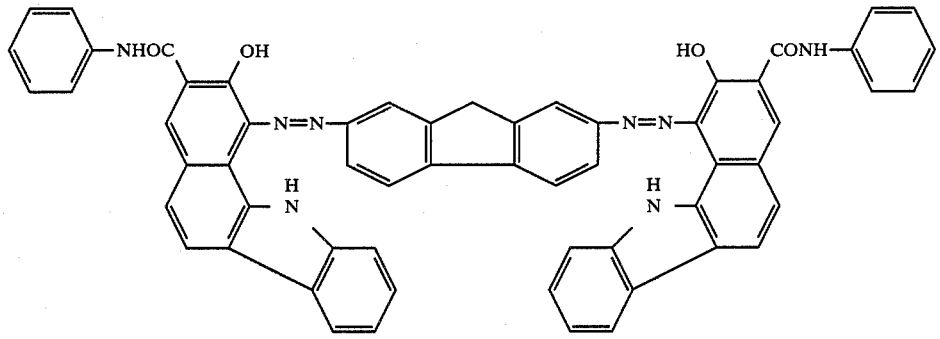

EXAMPLE 12

Photoreceptor was produced in the same manner as in Examples 2–6 except that Pigment No. (17) was used as the pigment and sensitivity of the photoreceptor was measured. Vo was −830 V and E ½ was 3.1 lux.sec. Spectral sensitivity curve of this photoreceptor is shown in FIG. 1.

EXAMPLE 13

One part by weight of pigment No. (53) and 1 part by weight of a polyester resin (Bylon-200 of Toyobo Co.) were added to 100 parts by weight of tetrahydrofuran and dispersion was effected together with glass beads for 2 hours. Thus obtained pigment dispersion was coated on a support comprising a polyester film clad with an aluminum foil by a wire bar. Thickness of this coating was 0.2μ.

On thus formed charge generating layer was coated a coating composition prepared by dissolving 1 part by weight of p-diethylaminobenzaldehyde-diphenylhydrazone and 1 part by weight of a polycarbonate resin in 10 parts by weight of dichloroethane by a wire bar to form a charge transport layer of 15μ thick. Thus obtained laminate photoreceptor was tested in the same manner as in Example 1. Vo of this photoreceptor was −738 V and the sensitivity E ½ was 3.5 lux.sec.

EXAMPLES 14–18

One part by weight of each of pigments No. (37), (39), (43), (50) and (51) and 1 part by weight of polyacrylate resin (U-100 of Unitika Ltd.) were added to 100 parts by weight of dichloroethane and dispersion was carried out in the same manner as in Example 13 to obtain a coating dispersion. This dispersion was coated on an anodized aluminum support for PS plate (Agfa-Gevaert) in the same manner as in Example 13 to form a charge generating layer of about 0.2–0.3μ thick.

On this charge generating layer was coated a coating composition prepared by dissolving 1 part by weight of p-dibenzylamino benzaldehyde-diphenylhydrazone as a charge transport substance and 1 part by weight of a polyarylate resin in 10 parts of dichloroethane in the same manner as in Example 13 to form a charge transport layer of about 15μ thick. White light sensitivity of thus produced photoreceptor was measured in the same manner as in Example 1. The results are shown in Table 3.

TABLE 3

| Example | Pigment No. | Vo | E ½ |
|---|---|---|---|
| 14 | (37) | −823 V | 3.5 lux · sec. |
| 15 | (39) | −817 | 3.4 lux · sec. |
| 16 | (43) | −766 | 2.8 lux · sec. |
| 17 | (50) | −845 | 3.1 lux · sec. |
| 18 | (54) | −748 | 2.5 lux · sec. |

For comparison, a photoreceptor was produced in the same manner as above except that the pigment of the following formula was employed. This photoreceptor had a Vo of −630 V and an E ½ of 8.3 lux.sec.

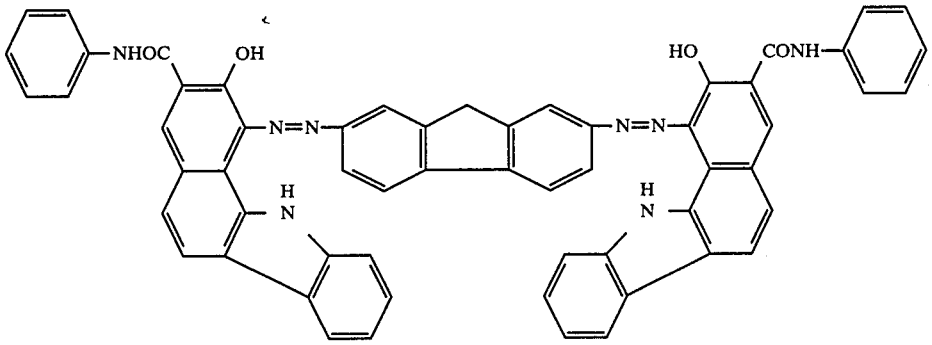

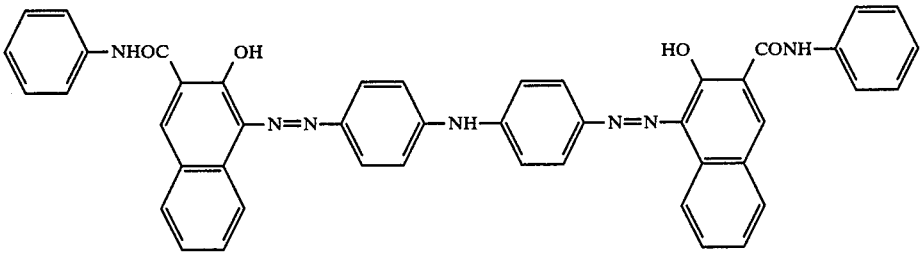

EXAMPLES 19–26

Two parts by weight of each of pigments No. (38), (40), (42), (56), (58), (60), (62) and (65) and 1 part by weight of polycarbonate resin (Panlite-1250 of Teijin Chemical Co.) were added to 50 parts by weight of dichloroethane and dispersion was carried out for 2 hours by a paint conditioner. The resulting dispersion was coated on the surface of an aluminum cylinder of 60 mm in outer diameter by cylinder drawing-up coating method. Thickness of the coating was about 0.5μ. On this charge generating layer was coated a coating composition prepared by dissolving 1 part by weight of 1-phenyl-3-(p-diethylaminostyryl)-5-(p-diethylaminophenyl)pyrazoline and 2 parts by weight of a polyester resin (Bylon-200) in 25 parts by weight of dichloroethane to form a charge transport layer of 15μ thick. White light sensitivity of thus obtained cylinder photoreceptor was measured. The results are shown in Table 4.

TABLE 4

| Example | Pigment No. | Vo | E ½ |
|---|---|---|---|
| 19 | (38) | −821 V | 6.2 lux · sec. |
| 20 | (40) | −732 | 5.8 lux · sec. |
| 21 | (42) | −883 | 6.7 lux · sec. |
| 22 | (56) | −733 | 5.4 lux · sec. |
| 23 | (58) | −845 | 2.0 lux · sec. |
| 24 | (61) | −877 | 1.8 lux · sec. |
| 25 | (62) | −910 | 2.4 lux · sec. |
| 26 | (64) | −728 | 1.6 lux · sec. |

For comparison, a photoreceptor was produced in the same manner as above except that a pigment of the following formula was used. This photoreceptor had a Vo of −582 V and the sensitivity E ½ of 12 lux.sec.

What is claimed is:

1. An electrophotographic photoreceptor which comprises a conductive support and a light-sensitive layer thereon containing a bis-azo pigment represented by the following general formula [I] or [II]:

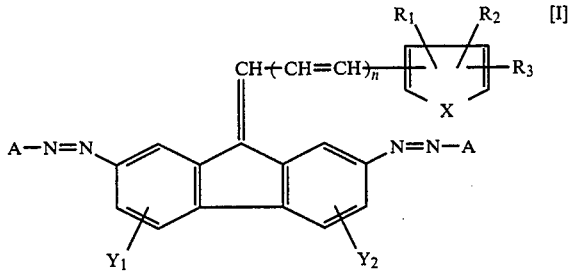

wherein X represents —O—, —S— or >N—$R_4$ where $R_4$ represents a hydrogen atom, an alkyl group or an aralkyl group, $R_1$, $R_2$ and $R_3$ each represent a hydrogen atom, an alkyl group, an alkoxy group, an aryl group or two of $R_1$, $R_2$ and $R_3$ being a group of atoms necessary to form a condensed ring by combination of them, $Y_1$ and $Y_2$ each represent a hydrogen atom, a halogen atom, an alkyl group or an alkoxy group, A represents a coupler residue necessary to produce an azo pigment and n is 0 or 1;

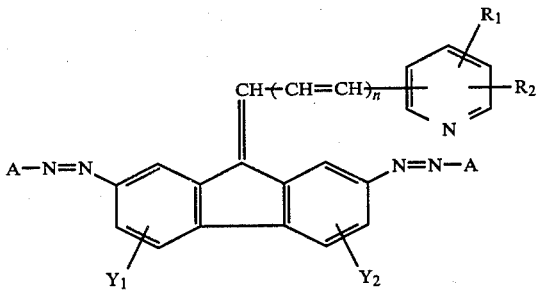

wherein $Y_1$ and $Y_2$ each represent a hydrogen atom, a halogen atom, an alkyl group or an alkoxy group, $R_1$ and $R_2$ each represent a hydrogen atom, an alkyl group, an alkoxy group or a group of atoms necessary to form a condensed ring by combination of $R_1$ and $R_2$, A represents a coupler residue necessary to produce an azo pigment and n is 0 or 1.

2. An electrophotographic photoreceptor wherein the bis-azo pigment has the following general formula [II-a]:

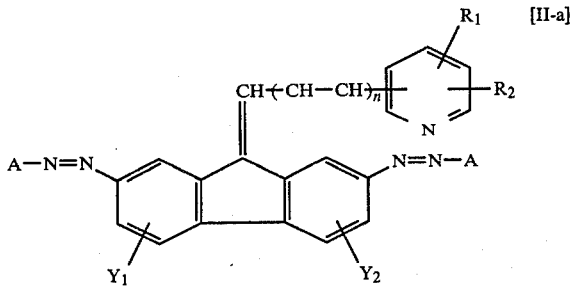

wherein $Y_1$, $Y_2$, $R_1$ and $R_2$ and n are the same as defined in the general formula [II], A is

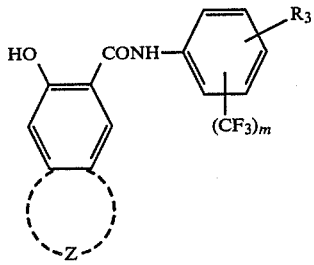

where m is 1 or 2, $R_3$ represents a hydrogen atom, a halogen atom, an alkyl group, cyano group and an alkoxy group and Z represents a condensed ring.

3. An electrophotographic photoreceptor according to claim 1 wherein the light-sensitive layer comprises a charge generating layer containing the bis-azo pigment and a charge transport layer.

4. An electrophotographic photoreceptor according to claim 1, wherein the light-sensitive layer comprises the bis-azo pigment and a binder.

5. An electrophotographic photoreceptor according to claim 4 wherein amount of the binder is 0.1–5 times the weight of the bis-azo pigment.

6. An electrophotographic process which comprises electrostatically charging the surface of the photoreceptor of claim 1, exposing it in imagewise fashion and then discharging the surface in the imagewise fashion.

* * * * *